US007139513B2

(12) United States Patent
Okamoto et al.

(10) Patent No.: US 7,139,513 B2
(45) Date of Patent: Nov. 21, 2006

(54) IMAGE FORMING APPARATUS HAVING A DEVELOPMENT AGENT CARTRIDGE ATTACHABLE IN A DIRECTION TANGENTIAL TO A ROTATING DIRECTION OF A DEVELOPMENT DEVICE

(75) Inventors: Masaya Okamoto, Saitama (JP); Katsumi Harumoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 118 days.

(21) Appl. No.: 10/942,956

(22) Filed: Sep. 17, 2004

(65) Prior Publication Data

US 2005/0175373 A1 Aug. 11, 2005

(30) Foreign Application Priority Data

Feb. 10, 2004 (JP) ..... P2004-034280

(51) Int. Cl.
*G03G 15/01* (2006.01)
*G03G 15/04* (2006.01)

(52) U.S. Cl. ..... 399/227; 399/119

(58) Field of Classification Search ..... 399/119, 399/226, 227

See application file for complete search history.

(56) References Cited

U.S. PATENT DOCUMENTS 6,072,969 A * 6/2000 Yokomori et al. ..... 399/119
6,104,898 A * 8/2000 Awano et al. ..... 399/119
6,104,900 A * 8/2000 Ishikawa et al. ..... 399/227
6,535,705 B1 * 3/2003 Asakura et al. ..... 399/119
6,834,173 B1 * 12/2004 Yamaguchi et al. ..... 399/119
6,889,024 B1 * 5/2005 Shiraki et al. ..... 399/227
6,915,094 B1 * 7/2005 Tsuruya et al. ..... 399/227

FOREIGN PATENT DOCUMENTS

JP 11-149211 6/1999

* cited by examiner

*Primary Examiner*—Sandra L. Brase
(74) *Attorney, Agent, or Firm*—Sughrue Mion, PLLC

(57) ABSTRACT

A developing device unit has a developing device unit main body which rotates about a rotary shaft. Plural developing devices are disposed on the developing device unit main body. The developing devices respectively have developing device main bodies, and developing agent cartridges containing four color developing agents are respectively loaded into the developing device main bodies. The developing agent cartridges are attached/detached in a direction substantially tangential to the rotating direction of the developing device unit main body when a grip section is gripped and operated by the operator in the case where the developing agent cartridges are at a location substantially opposite an image carrier with respect to the rotary shaft.

9 Claims, 19 Drawing Sheets

IMAGE FORMING APPARATUS HAVING A DEVELOPMENT AGENT CARTRIDGE ATTACHABLE IN A DIRECTION TANGENTIAL TO A ROTATING DIRECTION OF A DEVELOPMENT DEVICE

BACKGROUND OF THE INVENTION

1. Field of the Invention

The present invention relates to an image forming apparatus, such as a printer, a copying machine, or a facsimile machine.

2. Description of the Related Art

Known image forming apparatuses include those wherein four developing agent cartridges which contain developing agents of the four colors yellow, magenta, cyan, and black, respectively, are attached to a developing device unit which has four developing devices rotatably disposed, to thereby develop color images.

Such an image forming apparatus has a problem that an operator may touch a developing roller exposed out of a developing device when attaching/detaching a cartridge containing developing agent, with the result that his hand, or the like, is stained with the developing agent. To this end, there has been known a technique to cover a developing roller in the developing device with a shutter during attachment/detachment of a cartridge which is provided with a developing device and in which developing agent is contained, thereby preventing an operator's hand, or the like, from touching the developing roller (see JP-A-11-149211).

SUMMARY OF THE INVENTION

However, in the conventional image forming apparatus, he developing roller onto which developing agent is adhered is exposed in the vicinity of a developing position, and a direction in which the developing agent is exposed is substantially identical with a direction from which the operator approaches a grip section. Accordingly, there are cases where the operator touches a developing agent with his/her hand, or the like, when attaching/detaching the cartridge, resulting in staining of the same.

The present invention provides an image forming apparatus which prevents staining of an operator's hand or the like with developing agent during attachment/detachment of a developing agent cartridge.

To this end, according to one aspect of the present invention, there is provided an image forming apparatus comprising a developing device unit having a plurality of developing devices which are rotatably disposed and are sequentially displaced to a developing position for effecting image forming, wherein the developing device unit includes a developing agent cartridge which is removably attached at a replacement position in a direction orthogonal to a rotary shaft of the developing device unit and which contains developing agent. When a vertical plane including a rotation center of the developing device unit divides a space into a first space and second space, the developing position of the developing device is located in the first space, and the replacement position for the developing agent cartridges is located in the second space. Therefore, even when the developing agent is exposed in the vicinity of the developing position of the developing device, the exposed developing agent is hidden in the developing device unit at the replacement position for the developing agent cartridge; that is, during replacement of the developing agent cartridge, staining of an operator's hand or the like with the developing agent can be prevented.

According to another aspect of the present invention, there is provided an image forming apparatus comprising a developing device unit having a plurality of developing devices which are rotatably disposed and are sequentially displaced to a developing position for effecting image forming, wherein the developing device unit includes a developing agent cartridge which is removably attached at a replacement position in a direction orthogonal to a rotary shaft of the developing device unit and which contains developing agent. When a plane which is vertical to a line connecting a rotation center of the developing device unit and the developing position of the developing device divides a space into a first space and a second space, the developing position of the developing device is located in the first space, and the replacement position for the developing agent cartridges is located in the second space.

According to still another aspect of the present invention, there is provided an image forming apparatus comprising a developing device unit having a plurality of developing devices which are rotatably disposed and are sequentially displaced to a developing position for effecting image forming, wherein the developing device unit is removably attached at a replacement position in a direction orthogonal to a rotary shaft of the developing device unit and which contains developing agent, and the replacement position for the developing agent cartridge is located so as to substantially oppose the developing position of the developing device with respect to a rotation center of the developing device unit.

The developing agent cartridge preferably includes a developing agent supply port for supplying developing agent to the developing device, supply port open/close means for opening/closing the developing agent supply port, and a grip section for operating the supply port open/close means. Preferably, the supply port open/close means and the grip section are integrated with each other. When such a configuration is adapted, the developing agent supply port can be easily opened/closed without a complicated mechanism.

The developing agent cartridge is preferably attached to/detached from the developing device unit by means of an operator holding the grip section. When such a configuration is adapted, the operator can open/close the developing agent supply port or attach/detach the developing agent cartridge while gripping the grip section. As a result, he can replace the developing agent cartridge easily.

When the developing agent cartridge is detached from the developing device unit, the developing agent cartridge is preferably locked under a state where the developing agent supply port is closed by the supply port open/close means. When such a configuration is adapted, the developing agent will not leak from the developing agent cartridge even when the developing agent cartridge is detached from the developing device unit; that is, staining of an operator's hand or the like with the developing agent can be prevented.

The developing agent cartridge is preferably locked in the developing device unit when the developing agent cartridge is attached to the developing device unit with the developing agent supply port open. When such a configuration is adapted, erroneous removal of the developing agent cartridge from the developing device unit can be prevented, which in turn prevents staining of an operator's hand, or the like, with the developing agent.

A partition is preferably provided between the replacement position for the developing agent cartridge and the developing device which has been displaced in the second space. When such a configuration is adapted, the parturition wall can prevent an operator's hand or the like from touching the developing device which has been displaced in the second space; that is, staining of the operator's hand or the like with the developing agent can be prevented.

The image forming apparatus main body preferably further includes an opening through which the developing agent cartridge passes when the developing agent cartridge is attached to the developing device unit, and the opening is opened to a size substantially equal to that of the developing agent cartridge. When such a configuration is adapted, the operator's hand can be prevented from touching any developing device; that is, staining of the operator's hand or the like with the developing agent can be reliably prevented.

According to the present invention, during attachment/detachment of a developing agent cartridge, staining of an operator's hand or the like with developing agent can be prevented.

BRIEF DESCRIPTION OF THE DRAWINGS

These and other objects and advantages of this invention will become more fully apparent from the following detailed description taken with the accompanying drawings in which:

FIGS. 4A and 4B are diagrams showing the developing device for use in the image forming apparatus according to the embodiment of the invention, wherein FIG. 4A is a top view and FIG. 4B is a side view;

FIGS. 5A to 5C are diagrams showing the developing device for use in the image forming apparatus according to the embodiment of the invention, wherein FIG. 5A is across-sectional view taken along line D—D of FIG. 4A, FIG. 5B is across-sectional view taken along line E—E and viewed along the direction of F in FIG. 4A, and FIG. 5C is a cross-sectional view taken along line E—E and viewed along the direction of G of FIG. 4A;

FIGS. 7A to 7C are diagrams showing a state where the developing agent cartridge according to the embodiment of the invention is detached from the developing device, wherein FIG. 7A is a front view, FIG. 7B is a bottom view, and FIG. 7C is a side view;

FIGS. 9A to 9C are diagrams showing a state where the developing agent cartridge according to the embodiment of the invention is attached to the developing device, wherein FIG. 9A is a front view, FIG. 9B is a bottom view, and FIG. 9C is a side view;

FIGS. 13A to 13C are schematic diagrams showing a first locking mechanism for locking a rotating section main body of the developing agent cartridge according to the embodiment of the invention with respect to a cylinder section, wherein FIG. 13A shows a state where the developing agent cartridge is detached from the developing device, FIG. 13B shows a state where the developing agent cartridge is pressed against a support section of the developing device, and FIG. 13C shows a state where the first locking mechanism is released and the rotating section main body is rotated;

DETAILED DESCRIPTION OF THE PREFERRED EMBODIMETNS

Now, an embodiment of the present invention will be described with reference to the drawings.

Figure 1:
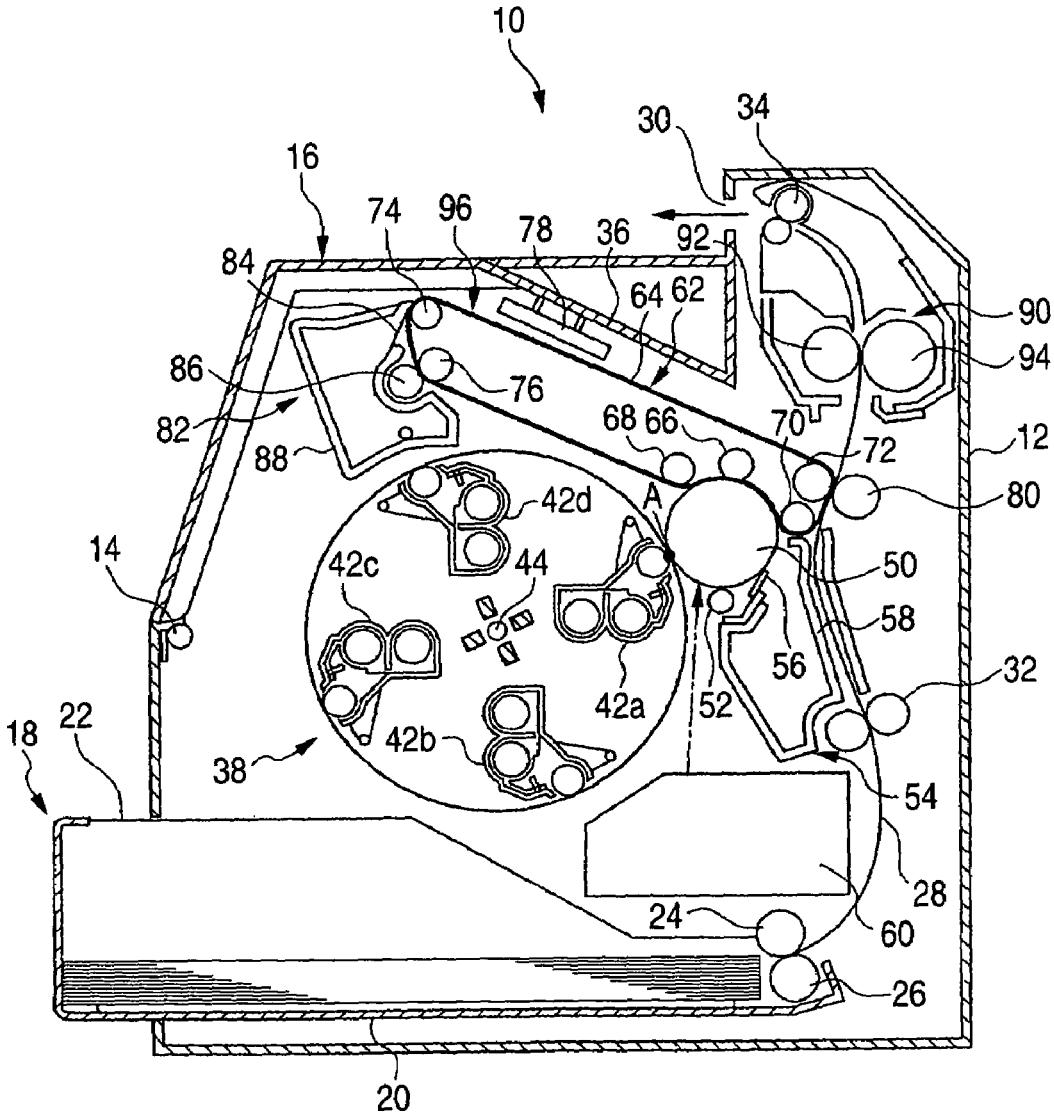
FIG. 1 is a side view of an image forming apparatus according to an embodiment of the present invention.

FIG. 1 shows a general feature of an image forming apparatus 10 according to an embodiment of the present invention. The image forming apparatus 10 includes an image forming apparatus main body 12. A reclosable cover 16, which is rotatable about a pivot 14, is disposed on the upper portion of the image forming apparatus main body 12, and a paper supply unit 18 of, e.g., a single stage is provided on the lower portion of the image forming apparatus main body 12.

The paper supply unit 18 has a paper supply unit main body 20, and a paper supply cassette 22 which contains paper. A feed roller 24 for supplying paper from the paper cassette 22 and a retard roller 26 for turning up a single sheet of paper at a time from the thus-supplied paper are disposed at an upper position in the vicinity of a deep inner end of the paper supply cassette 22.

A transport path 28 is a paper path from the feed roller 24 to a discharge port 30. The transport path 28 is disposed substantially vertically from the paper supply unit 18 to a fuser 90, which will be described later, in the vicinity of a back side (the right side face in FIG. 1) of the image forming apparatus main body 12. A secondary transfer roller 80 and a secondary transfer back-up roller 72, both of which will be described later, are disposed upstream of the fuser 90 along the transport path 28. Furthermore, a registration roller 32 is disposed upstream of the secondary transfer roller 80 and the secondary transfer back-up roller 72. In addition, a discharge roller 34 is disposed along the transport path 28, in the vicinity of the discharge port 30.

Therefore, paper fed out from the paper supply cassette 22 of the paper supply unit 18 by the feed roller 24 is turned up by the retard roller 26, only a sheet of paper on the top is guided to the transport path 28, and the sheet of paper is temporarily stopped by the registration roller 32. At an appropriate timing, a developing agent image is transferred to the paper at a proper timing while the paper passes between the secondary transfer roller 80 and the secondary transfer back-up roller 72, which will be described later. The thus-transferred developing agent image is fixed by the fuser 90, and discharged from the discharge port 30 to a discharge section 36 disposed on the upper portion of the reclosable cover 16, by means of the discharge roller 34. The discharge section 36 is inclined such that a discharge port section thereof is lowered, and gradually increases in height in a frontward direction (i.e., leftward in FIG. 1).

The image forming apparatus main body 12 includes a developing device unit 38 such as a rotary developing device at, e.g., a substantially center portion. The developing device unit 38 has developing devices 42*a* to 42*d* which respectively form four color developing agent images of yellow, magenta, cyan, and black. The developing devices 42*a* to 42*d* rotate leftward (i.e., counterclockwise in FIG. 1) about a rotary shaft 44.

An image carrier 50 formed from, e.g., a photosensitive material, is disposed so as to abut against the developing device unit 38 from the back side of the image forming apparatus 10. More specifically, the developing device unit 38 rotates counterclockwise about the rotary shaft 44, and a latent image on the image carrier 50 is developed with the developing agents of the respective colors at a developing position A.

An electrifying device 52 configured from, e.g., a charging roller, which uniformly charges the image carrier 50, is disposed under the image carrier 50. Furthermore, an image carrier cleaner 54 abuts against the image carrier 50 upstream of the electrifying device 52 with respect to a rotating direction of the image carrier 50. The image carrier cleaner 54 is configured from, e.g., a cleaning blade 56 which scrapes developing agent residues remaining on the image carrier 50 after a first transfer, and a developing agent collecting bottle 58 which collects the developing agent scraped by the cleaning blade 56.

A rib, or the like, is disposed on the back side (the right side in FIG. 1) of the developing agent collecting bottle 58, and is warped to forms a part of the transport path such that paper is transported smoothly.

An exposure device 60 for recording a latent image on the image carrier 50, which has been charged by the electrifying device 52, by means of light rays, such as a laser beam, is disposed under the developing device unit 38. An intermediate transfer device 62 is provided above the developing device unit 38. The intermediate transfer device 62 performs primary transfer of a developing agent image visualized by the developing device unit 38 at a primary transfer position, and transports the image thus primarily transferred to a secondary transfer position, which will be described later.

The intermediate transfer device 62 is configured from an intermediate member 64, such as an intermediate transfer belt, a primary transfer roller 66, a wrap-in roller 68, a wrap-out roller 70, the secondary back-up roller 72, a scraper back-up roller 74, and a brush back-up roller 76. The intermediate transfer member 64 has, e.g., elasticity, and is stretched substantially flat in such a manner that longer and shorter sides thereof are placed above the developing device unit 38. The longitudinal sides of the upper surface of the intermediate transfer member 64 are stretched, e.g., so as to be substantially parallel to the discharge section 36 provided on the upper portion of the image forming apparatus main body 12. Furthermore, the intermediate transfer member 64 has the wrap-in roller 68 disposed upstream of the primary transfer roller 66 below the longitudinal sides of the intermediate member 64 and a primary transfer section (image carrier wrap range) abutting against the image carrier 50 in a wrapping manner between the wrap-out roller 70 disposed downstream of the primary transfer roller 66. The intermediate transfer member 64 wraps around the image carrier 50 only over a predetermined range, to thus be driven by rotation of the image carrier 50. As described above, the intermediate transfer member 64 is subjected to primary transfer of the developing agent image on the image carrier 50 by, for instance, superposing yellow, magenta, cyan, and black developing agents, in the order given, and transports the thus-primarily-transferred developing agent image toward the secondary transfer roller 80, which will be described later.

The wrap-in roller 68 and the wrap-out roller 70 are separated from the image carrier 50.

Furthermore, a flat portion (transverse sides) is formed by the wrap-out roller 70 and the secondary transfer back-up roller 72 on a back side (the right side face in FIG. 1) of the intermediate transfer member 64. The flat portion serves as a secondary transfer section which faces the transport path 28.

The wrap-out roller 70 in the secondary transfer section is disposed such that the intermediate transfer member 64 and the transport path 28 form an angle of, e.g., 12.

The scraper back-up roller 74 assists a scraper 84, which will be described later, to scrape developing agent residues remaining on the intermediate transfer member 64 after a secondary transfer. The brush back-up roller 76 assists a brush roller 86, which will be described later, to scrape developing agent residues remaining on the intermediate transfer member 64 after the secondary transfer.

A sensor 78, such as a reflective photo sensor, is disposed above the longitudinal sides of the intermediate transfer member 64 by means of being fixed on the back side (i.e., the inner side) of the reclosable cover 17. The sensor 78 reads a patch of the developing agent formed on the intermediate transfer member 64, thereby detecting a position of the intermediate transfer member 64 in the rotating direction, as well as sensing a developing agent concentration.

The secondary transfer roller 80 is disposed so as to oppose the secondary transfer back-up roller 72 with the transport path 28 therebetween. More specifically, a portion between the secondary transfer roller 80 and the secondary transfer back-up roller 72 serves as the secondary transfer position in the secondary transfer section. The secondary transfer roller 80 performs secondary transfer of the developing agent image, which has been primarily transferred on the intermediate transfer member 64, on to paper at the secondary transfer position with assistance of the secondary back-up roller 72. The secondary transfer roller 80 is separated from the intermediate transfer member 64 while the intermediate transfer member 64 rotates three times; i.e., during transportation of developing agents of the colors yellow, magenta, and cyan. Furthermore, the secondary transfer roller 80 abuts the intermediate transfer member 64 after completion of transfer of the black developing agent. The secondary transfer roller 80 and the secondary transfer back-up roller 72 are configured such that a predetermined potential difference is generated therebetween. For instance, when the secondary transfer roller 80 is under a high potential, the secondary transfer back-up roller 72 is connected to the ground (GND), or the like.

An intermediate transfer member cleaner 82 is disposed at the end of the intermediate transfer member 64 opposing the image carrier 50 so as to abut the intermediate transfer member 64. The intermediate transfer member cleaner 82 is configured from the scraper 84, the brush roller 86, and a developing agent collecting bottle 88. The scraper 84 scrapes developing agent residues remaining on the intermediate transfer member 64, e.g., after a secondary transfer, thereby performing cleaning. The brush roller 86 further scrapes developing agent residues remaining after the cleaning by the scraper 84. The developing agent collecting bottle 88 collects the developing agent scraped by the scraper 84 and the brush roller 86. The scraper 84 is made of, e.g., a thin metal plate such as stainless steel, and a voltage having a polarity opposite that of the developing agent is applied on the scraper 84. The brush roller 86 is made of, e.g., an acrylic brush which has been subjected to conductivity processing. Furthermore, the scraper 84 and the brush roller 86 are separated from the intermediate transfer member 64 during transportation of the developing agent by the intermediate transfer member 64, and the scraper 84 and the brush roller 86 abut against the intermediate transfer member 64 at a predetermined timing in an integrated manner.

The fuser 90 is disposed above the secondary transfer position. The fuser 90 has a heating roller 92 and a pressing roller 94. The fuser 90 fixes the developing agent image, which has been secondarily transferred on the paper by the secondary transfer roller 80 and the secondary transfer back-up roller 72, on the paper, and transports the thus-fixed paper toward the discharge roller 34.

An image forming unit 96 is configured by integrating the intermediate transfer device 62, the image carrier 50, the electrifying device 52, the image carrier cleaner 54, and the intermediate transfer member cleaner 82. More specifically, in the image forming unit 96, the intermediate transfer device 62 having the intermediate transfer member 64 extends on the front side of the image carrier 50, and the image carrier cleaner 54 is disposed below the back side of the image carrier 50. Furthermore, in the image forming unit 96, the intermediate transfer member cleaner 82 is disposed at the end of the intermediate transfer device 62 opposing the image carrier 50. As described above, the image forming unit 96 is bent such that the direction in which the intermediate transfer member 64 extends, and the direction in which the image carrier cleaner 54 is disposed, form an angle larger than 90° and smaller than 180° with the secondary transfer position serving as a vertex, thereby surrounding the developing device unit 38. The image forming unit 96 is disposed immediately below the discharge section 36 of the reclosable cover 16. The image forming unit 96 is removable from the image forming apparatus main body 12, and is attached/detached by means of opening the reclosable cover 16.

In addition, each of the image carrier 50, the image carrier cleaner 54, the intermediate transfer member 64, and the intermediate transfer member cleaner 82 is removable from the image forming unit 96.

Next, the developing device unit 38 and its vicinity will be described in detail.

Figure 2:
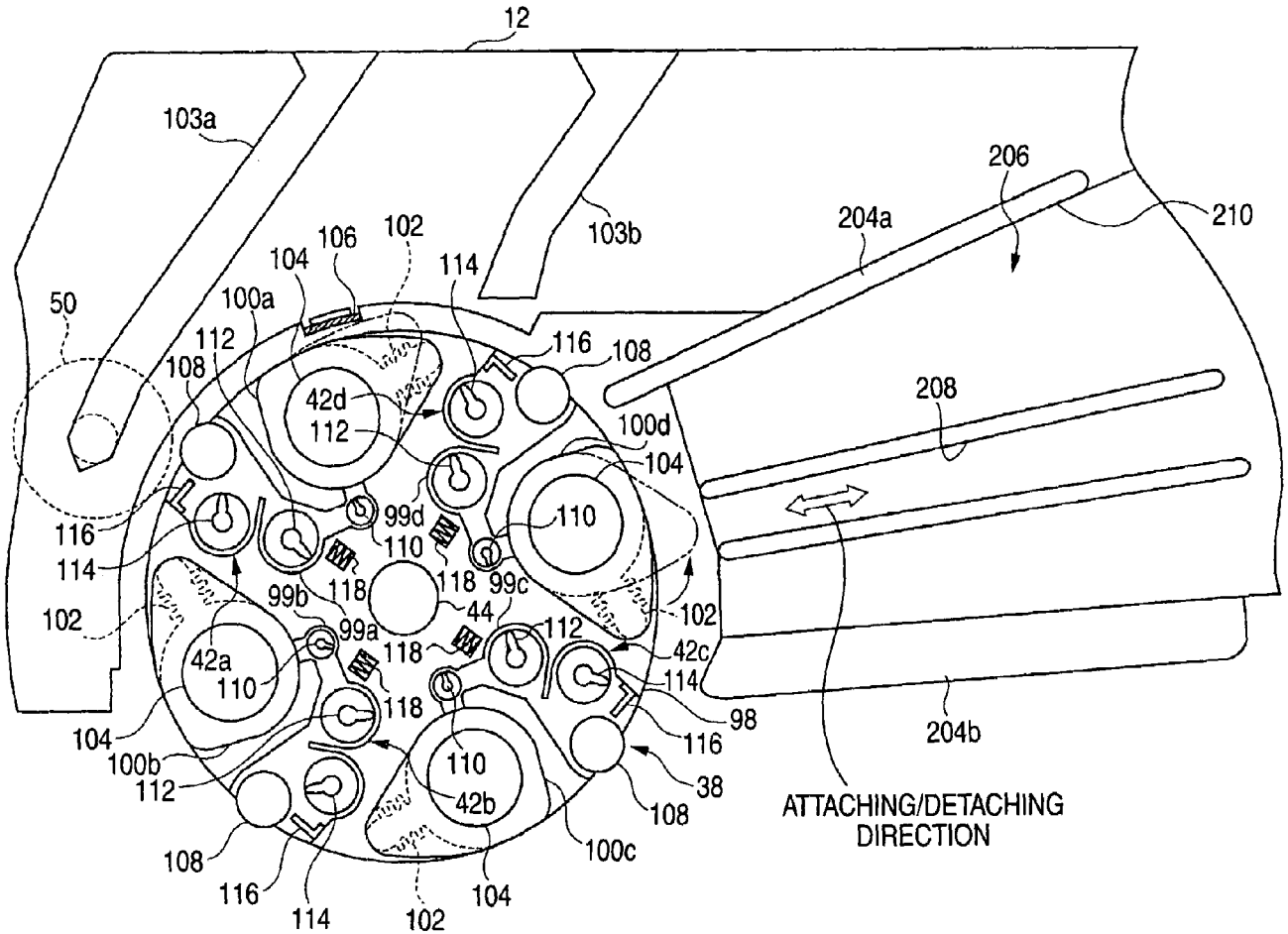
FIG. 2 is a side view showing a developing device unit for use in the image forming apparatus according to the embodiment of the invention and its vicinity.

FIG. 2 shows the developing device unit 38 and its vicinity. The developing device unit 38 has a developing device unit main body 98 which rotates about the rotary shaft 44. The aforementioned developing devices 42*a* to 42*d* are removably disposed on the developing device unit main body 98. The developing devices 42*a* to 42*d* respectively have developing device main bodies 99*a* to 99*d*. Toner cartridges 100*a* to 100*d* containing the aforementioned four color developing agents are respectively attached to the developing device main bodies 99*a* to 99*d*. Each of the developing agent cartridges 100*a* to 100*d* is formed in the shape of a cylinder on which a grip section 102 is formed at a longitudinal end. Furthermore, the outer surfaces of the developing agent cartridges 100*a* to 100*d* substantially coincide with the outer periphery of the developing device unit main body 98 when attached on the developing device unit main body 98 by way of the developing devices 42*a* to 42*d*.

Figure 3:
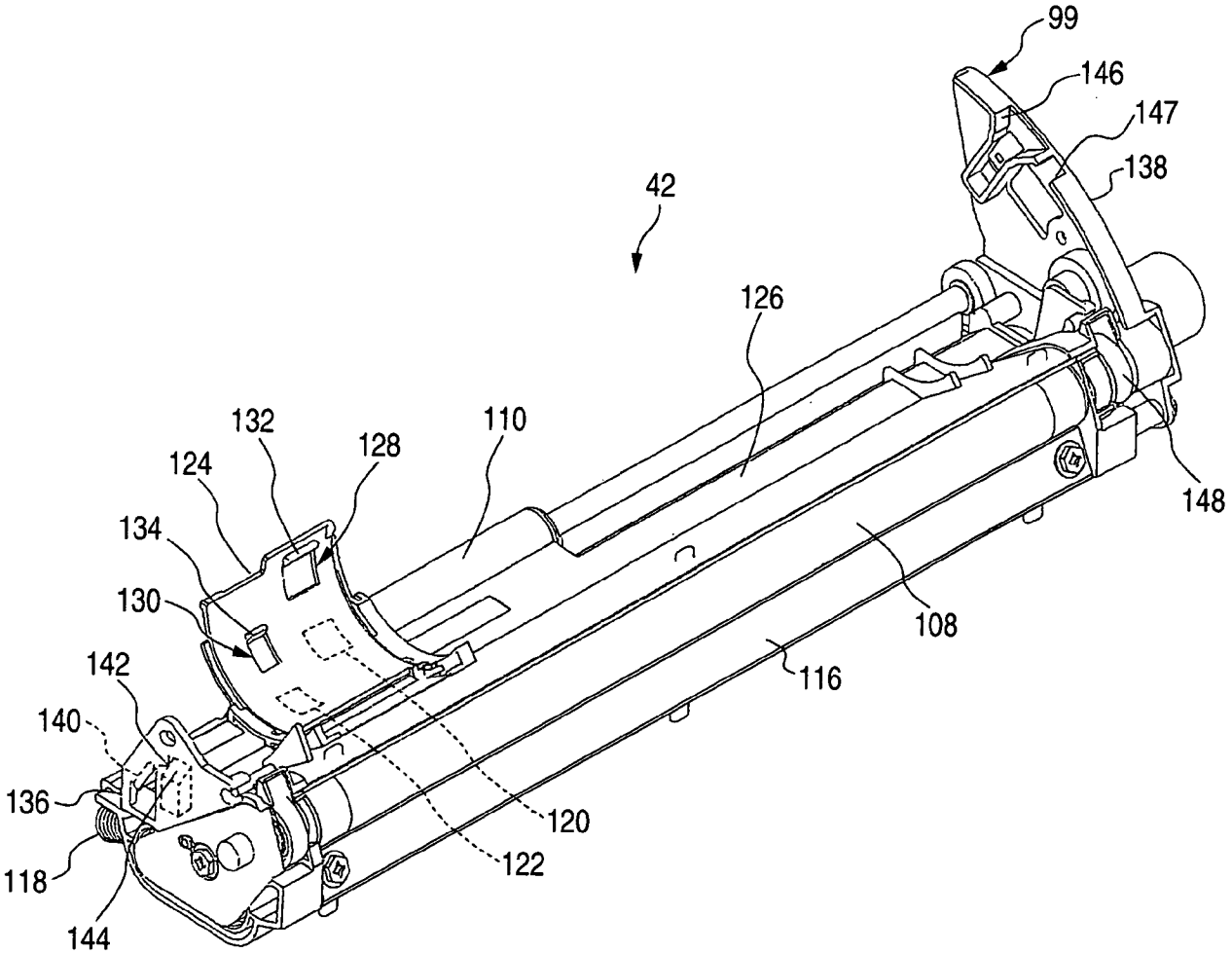
FIG. 3 is a perspective view showing the developing device or use in the image forming apparatus according to the embodiment of the invention.
Figure 4A:
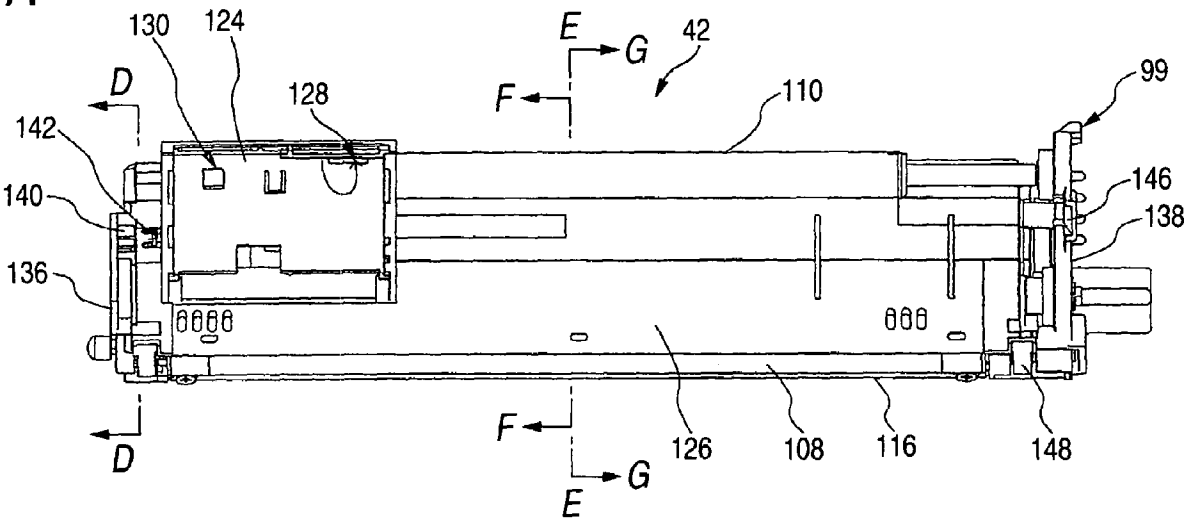
Figure 4B:
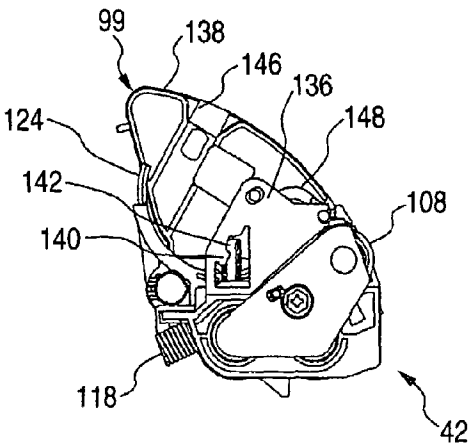
Figure 5A:
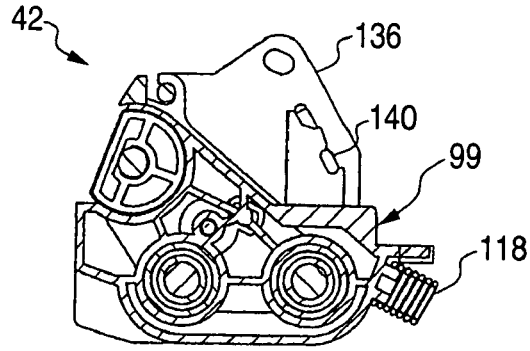
Figure 5B:
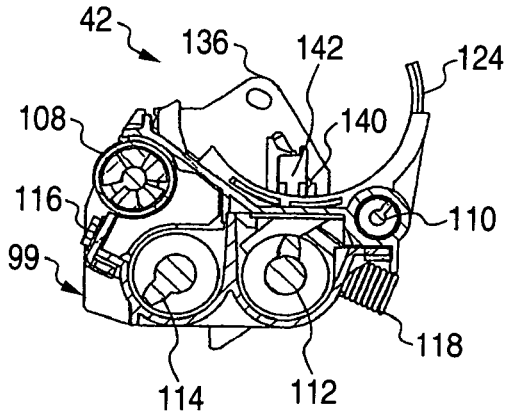
Figure 5C:
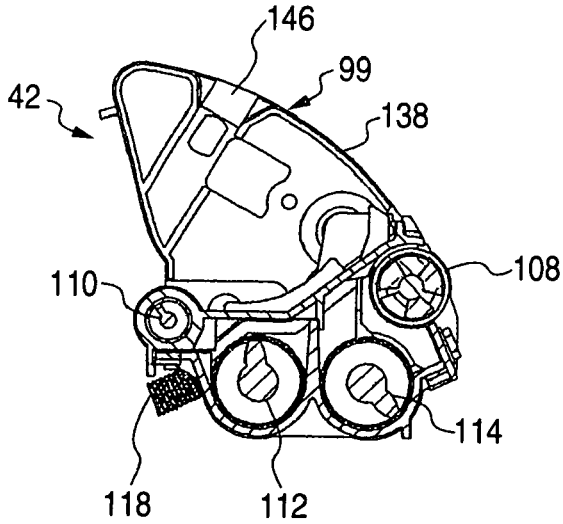
Figure 6:
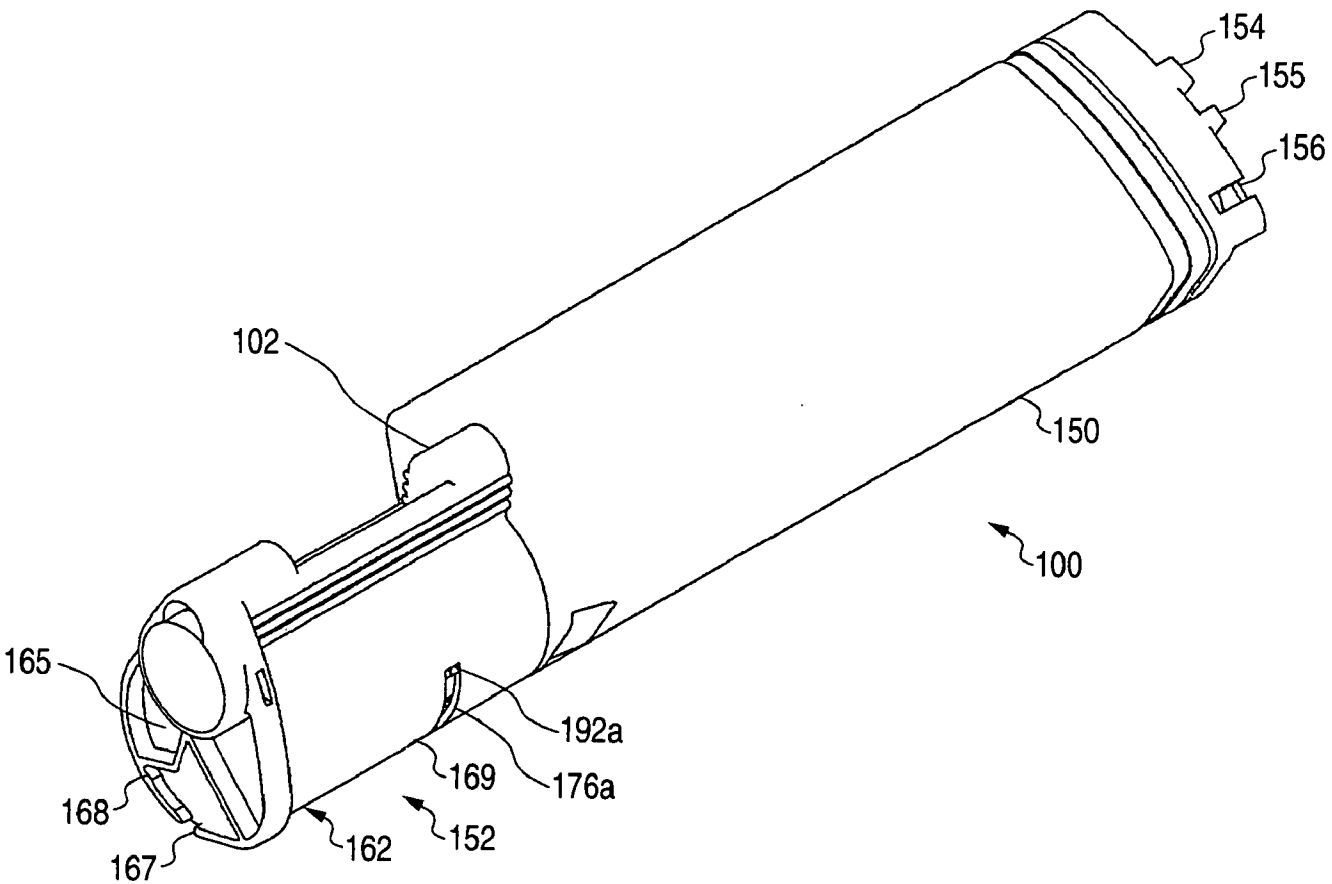
FIG. 6 is a perspective view showing a developing agent cartridge according to the embodiment of the invention.

The respective developing agent cartridges 100*a* to 100*d* are removable in a direction substantially tangential to the rotating direction of the developing device unit main body 98, and a position substantially opposite the image carrier 50 with respect to the rotary shaft 44 serves as a replacement position. More specifically, the respective developing agent cartridges 100*a* to 100*d* are rotated about the rotary shaft 44 to the replacement position on the front side of the image forming apparatus 10 (the right side in FIG. 2) by an unillustrated control section. When the grip section 102 is gripped and operated by an operator, the respective developing agent cartridge 100*a* to 100*d* is guided by a guide 146 (which will be described later by reference to FIG. 3, or the like) of the respective developing device main body 99*a* to 99*d*, there by being attached on/detached from the front side of the image forming apparatus 10.

Furthermore, in the image forming apparatus main body 12, e.g., partitions 204*a* and 204*b* are provided above and below with respect to the direction where the developing agent cartridges 100*a* to 100*d* are attached/detached. A guide plate 206 for guiding the developing agent cartridges 100*a* to 100*d* is disposed between the partitions 204*a* and 204*b*. The guide plate 206 having a guide groove 208 is located so as to be separated, e.g., 12 mm from the developing device unit main body 98. The guide groove 208 guides the respective developing agent cartridges 100*a* to 100*d* to the attaching/detaching direction by, e.g., being passed through by a protruding section 154 and a protrusion 155, which will be described later, of each of the developing agent cartridges 100*a* to 100*d*. More specifically, the guide 146 and the guide groove 208 are located so as to have a gap therebetween which is smaller than the width of the cartridges 100*a* to 100*d* in the attaching/detaching direction, thereby forming a guide path for guiding the developing agent cartridges 100*a* to 100*d*. A gap between the partitions 204*a* and 204*b* serves as a path where the respective developing agent cartridges 100*a* to 100*d* travel when being attached/detached. An opening 210 opened to a size substantially equal to that of the developing agent cartridges 100*a* to 100*d* is formed on the front side (the right side in FIG. 2) of the partitions 204*a* and 204*b*. In other words, the developing agent cartridges 100*a* to 100*d* pass through the opening 210 and between the partitions 204*a* and 204*b*, and are guided by the guide groove 208 and the guide 146, thereby being attached to/detached from respect to the developing device main bodies 99*a* to 99*d*.

As described above, the partitions 204*a* and 204*b* are provided above and below with respect to the direction in which the developing agent cartridges 100*a* to 100*d* are attached/detached; and the guide plate 206 and the developing device unit main body 98 are located with a small gap therebetween. Accordingly, a restriction is applied on the range where the operator's hand after having passed through the opening 210 can move. That is, when the operator attaches/detaches the respective developing agent cartridges 100*a* to 100*d*, the operator's hand will not touch the developing roller 108 (which will be described by reference to FIG. 2) displaced to the replacement position side of the developing cartridge 100*a* to 100*d* which is substantially opposite the image carrier 50 with respect to the rotary shaft 44.

The image forming unit 96 (FIG. 1) is attached/detached along guides 103*a* and 103*b* (FIG. 2) provided on the image forming apparatus main body 12 when the reclosable cover 16 is opened. Meanwhile, a rib 106 is provided above the vicinity of the developing device unit 38. Therefore, when positioned above the developing device unit 38, the developing agent cartridges 100*a* to 100*d* are prevented from being detached even when the top of the developing device unit 38 is opened.

Auger conveying members 104 are respectively provided inside the developing agent cartridges 100*a* to 100*d*. The auger conveying members 104 supply the developing agents contained there into the developing devices 42*a* to 42*d* by means of agitating transportation.

Each of the developing devices 42*a* to 42*d* has a developing roller 108, a first auger conveying member 110, a second auger conveying member 112, a third auger conveying member 114, and a layer thickness regulation member 116, and is pressed in the direction substantially tangential to the rotating direction of the developing device unit main body 98 by means of an elastic member 118, such as a coil spring. A portion of an outer periphery of each of the developing rollers 108 projects, e.g., 2 mm in the radial direction from the outer periphery of the developing device unit main body 98, while being detached from the image carrier 50. Furthermore, tracking rolls (unillustrated) having a slightly larger radius than that of the developing rollers 108, are disposed on opposing ends of the respective developing rollers 108 so as to rotate about the same axes with the respective developing rollers 108. More specifically, the respective developing rollers 108 are disposed at 90° intervals on the outer periphery of the developing device unit main body 98, and tracking rollers of the developing rollers 108 abut against flanges (unillustrated) disposed on opposing ends of the image carner 50. As a result, a latent image on the image carrier 50 is developed with developing agents of the respective colors while a gap of a predetermined size is maintained between the developing rollers 108 and the image carrier 50.

The first auger conveying member 110 transports the developing agent supplied from the corresponding developing agent cartridge 100*a* to 100*d* to the second auger conveying member 112. The second auger conveying member 112 agitates and supplies the developing agent to the development roller 108 by way of the third auger conveying member 114. The layer thickness regulation member 116 restricts the thickness of developing agent adhering on the surface of the developing roller 108.

The developing devices 42*a* to 42*d* are removable from the developing device unit main body 98, even in the state where the respective developing agent cartridges 100*a* to 100*d* are attached thereto.

Hereinafter, when one of a plurality of components, such as the developing devices 42*a* to 42*d*, is denoted without designating a specific one thereof, it may be denoted as, for instance, "the developing device 42."

Next, the developing device 42 will be described in detail.

FIGS. 3 to 5C show details of the developing device 42. As described above, the developing device 42 has the developing roller 108, the first auger conveying member 110, the second auger conveying member 112, the third auger conveying member 114, and the layer thickness regulation member 116. In addition, there is slidably disposed a developing device unit shutter 124, which opens and closes a developing agent inlet port 120 and a developing agent discharge port 122, in the vicinity of one end (the left side in FIG. 3) of the developing device main body 99.

The developing agent inlet port 120 is disposed on the developing device main body 99 and receives the developing agent supplied from the developing agent cartridge 100. The developing agent discharge port 122 is disposed on the developing device main body 99 and discharges developing agent, or the like, which has been excessively supplied into the developing device 42 to the developing agent cartridge 100.

The developing device unit shutter 124 which is a plate-shaped member and a supporting member 126 formed on the upper surface of the developing device main body 99 are curved in conformance with the shape of the developing agent cartridge 100 so that the developing agent cartridge 100 can be attached thereto. An inlet port opening section 128 and a discharge port opening section 130 are disposed on the developing device shutter 124. The inlet port opening section 128 opens in a shape substantially identical with that of the developing agent inlet port 120, thereby opening the developing agent inlet port 120 when superposed thereon. The discharge port opening section 130 opens in a shape substantially identical with that of the developing agent discharge port 122, thereby opening the developing agent discharge port 122 when superposed thereon.

The inlet port opening section 128 has an inlet port protrusion 132 at the rear end thereof (the upper side in FIG. 3) in a direction such that the developing device shutter 124 causes the developing agent inlet port 120 to open, and a supply port protrusion 178, which will be described later, on the developing agent cartridge 100 abuts against the inlet port protrusion 128. A discharge port protrusion 134 is disposed on the discharge port opening section 130 at the rear end (the upper side in FIG. 3) thereof in a direction such that the developing device shutter 124 slides the developing agent discharge port 122 to open. A collecting port protrusion 180, which will be described later, on the developing agent cartridge 100 abuts against the inlet port protrusion 134.

Furthermore, a side plate 136 is disposed on the developing device main body 99 at the end portion on the developing device shutter 124 side; and a side plate 138 is disposed at the end portion on the side opposite the developing device shutter 124. There is disposed a regulation section 140 which restricts the range over which a rotating section main body 162, which will be described later, of the developing agent cartridge 100 rotates and which restricts slip off of the rotating section main body 162 under a state where the developing agent cartridge 100 is attached to the developing device 42 on the side plate 136. Further, a release rib 142 to be engaged with an elastic claw 166, which will be described later, of the developing agent cartridge 100 is disposed in a protruding manner in the vicinity of the side plate 136 so as to oppose the side plate 136. A tilt surface 144, whose thickness is small in the upper portion (the upper side in FIG. 3) and large in the lower portion, is formed on the release rib 142.

The side plate 138 has the guide 146 and a C-shaped hole 147. The guide 146 receives the protruding section 154, which will be described later, on the developing agent cartridge 100, and guides the developing agent cartridge 100 so as to attach the same in a predetermined direction. When the protrusion 155, which will be described later, on the developing agent cartridge 100 is disposed at a predetermined location, the C-shaped hole 147 engages with the protrusion 155. The C-shaped holes 147 are disposed on the side plates 138 of the respective developing device main bodies 99*a* to 99*d* such that their locations differ from each other.

Furthermore, a driving force transmitting section 148 configured with, e.g., a plurality of gears is disposed in the vicinity of the side plate 138. The driving force transmitting section 148 receives driving force from the image forming apparatus main body 12, and transmits the driving force to the developing roller 108, the first auger conveying member 110, the second auger conveying member 112, and the third auger conveying member 114.

Next, the developing agent cartridge 100 will be described in detail.

FIGS. 6 to 10 show details of the developing agent cartridge 100. The developing agent cartridge 100 has a developing agent cartridge main body 150, and a rotating section 152 disposed at a longitudinal end of the developing agent cartridge main body 150.

The developing agent cartridge main body 150 is formed in a cylindrical shape, which is a tear-drop shape when viewed in profile. More specifically, the developing agent cartridge main body 150 is formed such that a substantially cylindrical section, inside which the auger conveying member 104 is disposed, and a portion which extends substantially orthogonally to the longitudinal direction of the substantially cylindrical section and which is gradually narrowed are integrated. Furthermore, the outer surface of the developing agent cartridge main body 150 substantially coincides with the outer periphery of the developing device unit main body 98 when the developing agent cartridge 100 is attached to the developing device unit main body 98 by way of the developing device 42.

The protruding section 154 to be engaged with the aforementioned guide 146 of the developing device 42, the protrusion 155 to be engaged with the C-shaped hole 147, and e.g., a gear 156 to be meshed with the driving force transmitting section 148 of the developing device 42 are disposed on the developing agent cartridge main body 150 at the end portion opposite the rotating section 152. The protrusions 155 are disposed at different locations corresponding to the developing agent colors contained in the developing agent cartridge main bodies 150. More specifically, only a single developing agent cartridge among the developing agent cartridges 100*a* to 100*d*, which contains the predetermined color developing agent, is allowed to be attached to a corresponding one of the developing device main bodies 99*a* to 99*d*.

A developing agent storing space 158 for storing developing agent to be supplied to the developing device 42 is formed in the developing agent cartridge main body 150. The aforementioned auger conveying member 104 is provided in the developing agent storing space 158. The auger conveying member 104 is, e.g., winded in a spiral, and applies agitating transportation to the developing agent in the developing agent storing space 158.

The rotating section 152 has the rotating section main body 162, and a cylinder section 164 which is provided in the rotating section main body 162 and which is integrally formed with the developing agent cartridge main body 150.

The developing agent cartridge main body 162, the inner side of which is formed in a cylindrical shape, rotates along the outer cylindrical surface of the cylinder section 164, and assumes the shape of a tear-drop when viewed in profile. More specifically, the rotating section main body 162 has a portion which corresponds to the deeper side when attached to the developing device 42 and which is formed in a substantially cylindrical shape. The grip section 102 protrudes from the substantially cylindrical section in such a manner that the side surface section 165 (in front in FIG. 7C) is formed in a shape substantially identical with that of the side surface of the developing agent cartridge main body 150. Furthermore, the outer surface of the rotating section main body 162 substantially coincides with the outer periphery of the developing device unit main body 98 when the developing agent cartridge 100 is attached to the developing device unit main body 98 by way of the developing device 42.

The elastic claw 166, which is bent inward with respect to the rotating section main body 162 and elastically extends in the rotating direction of the rotating section main body 162, an attachment/detachment groove 167, and a receiving groove 168 are disposed on the side surface section 165. Furthermore, in relation to the rotating section main body 162, a cylindrical cartridge shutter 169 for opening and closing a developing agent supply port 188 and a developing agent collecting port 190, which will be described later, are formed on the surface rotating along the cylinder section 164. The cartridge shutter 169 includes a supply port opening section 170, a collecting port opening section 172, a rib hole 174, and regulation holes 176*a*, 176*b*, and is integrally formed with the aforementioned grip section 102.

The supply port opening section 170 has the supply port protrusion 178 and is opened in a shape substantially identical with that of the developing agent supply port 188, which will be described later, thereby opening the developing agent supply port 188 when superposed thereon. The collecting port opening section 172 has the collecting port protrusion 180 and is opened in a shape substantially identical with that of the developing agent collecting port 190, which will be described later, thereby opening the developing agent collecting port 190 when superposed thereon. The rib hole 174 is opened and extends in the rotating direction of the rotating section main body 162 so that the rotating section main body 162 can rotate while being penetrated by the release rib 142 of the developing device 42 when the developing agent cartridge 100 is attached to the developing device 42. The regulation holes 176*a* and 176*b* respectively engage with regulation protrusions 92*a* and 92*b*, which will be described later, and are opened extending in the rotating direction of the rotating section main body 162, so as to restrict the range over which the rotating section main body 162 rotates.

The side of the cylinder section 164 which is closer to the side surface section 165 of the rotating main body 162 is sealed by a cylinder sidewall 182. The cylinder section 164 has a partition 184 inside. The aforementioned elastic claw 166 and a locking protrusion 183 constituting a first locking mechanism, which will be described later, of the rotating section 152 are provided on the cylinder sidewall 182. A developing agent collecting space 186 is formed on the partition 184 on the cylinder-sidewall 182 side. The aforementioned developing agent storing space 158 is formed in an extended manner on the side of the partition 184 opposite the cylinder sidewall 182. Furthermore, the developing agent supply port 188 is disposed on the cylinder section 164 in the vicinity of the partition 184 on the developing agent storing space 158 side; and the developing agent collecting port 190 is disposed in the vicinity of the cylinder sidewall 182 on the developing agent collecting space 186 side. That is, the developing agent stored in the developing agent storing space 158 is supplied into the developing device 42 by way of the developing agent supply port 188 and the developing agent inlet port 120 of the developing device 42. Furthermore, the developing agent excessively supplied into the developing device 42 is collected into the developing agent collecting space 186 by way of the developing agent discharge port 122 and the developing agent collecting port 190 of the developing device 42.

The regulation protrusions 192*a* and 192*b* are disposed on the outer cylindrical surface of the cylinder section 164. The regulation protrusions 192*a* and 192*b* respectively slide along the regulation holes 176*a* and 176*b*, thereby restricting the range over which the rotating section main body 162 rotates with respect to the cylinder section 164.

As described above, the developing agent cartridge main body 150 and the rotating section main body 162 are formed in the shape of a tear-drop when viewed in profile. Therefore, the grip section 102 is provided without a reduction in the amount of the developing agent that can be contained.

Figure 11:
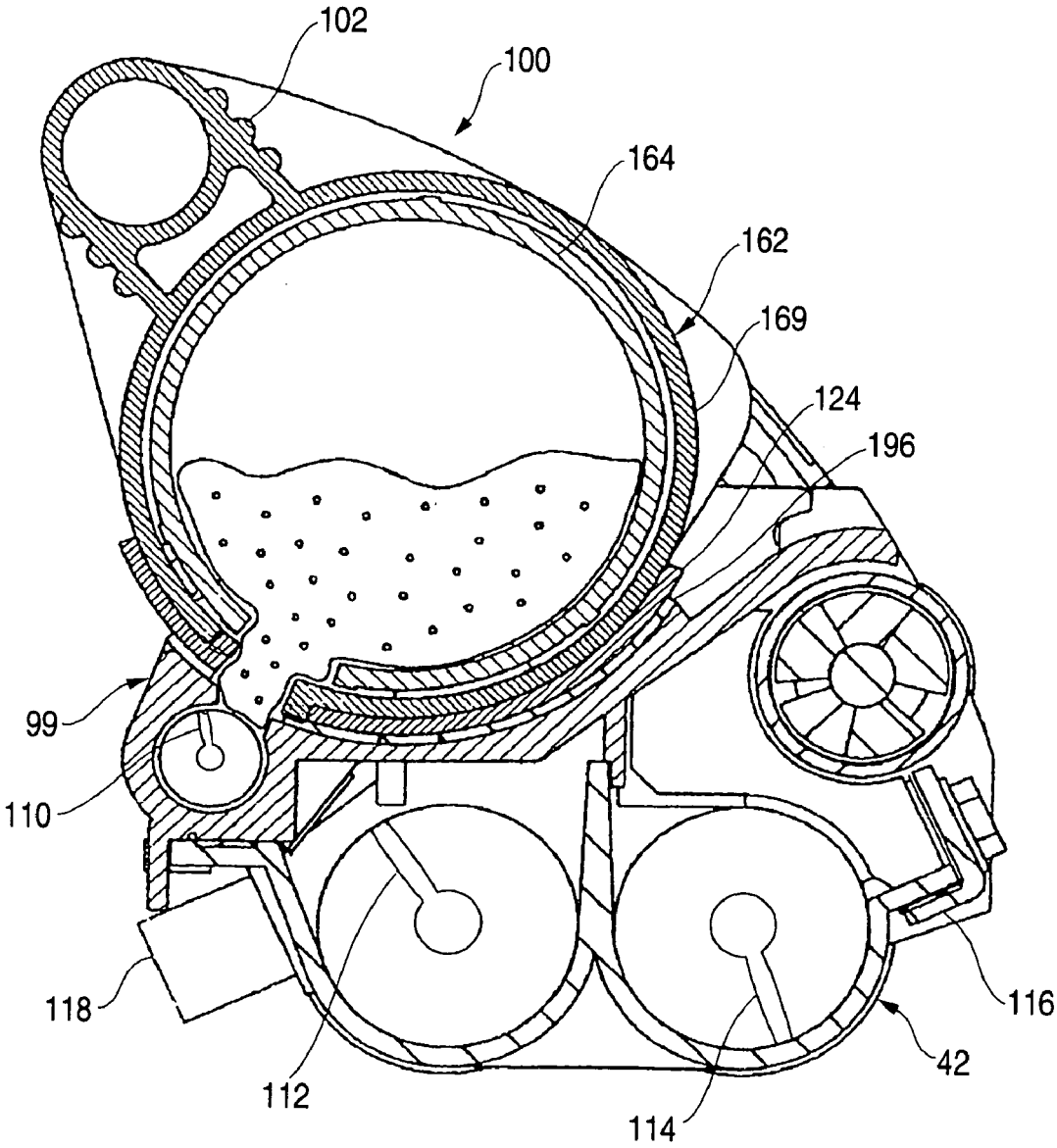
FIG. 11 is another cross-sectional view showing a state where the developing agent cartridge according to the embodiment of the invention is attached to the developing device.
Figure 12:
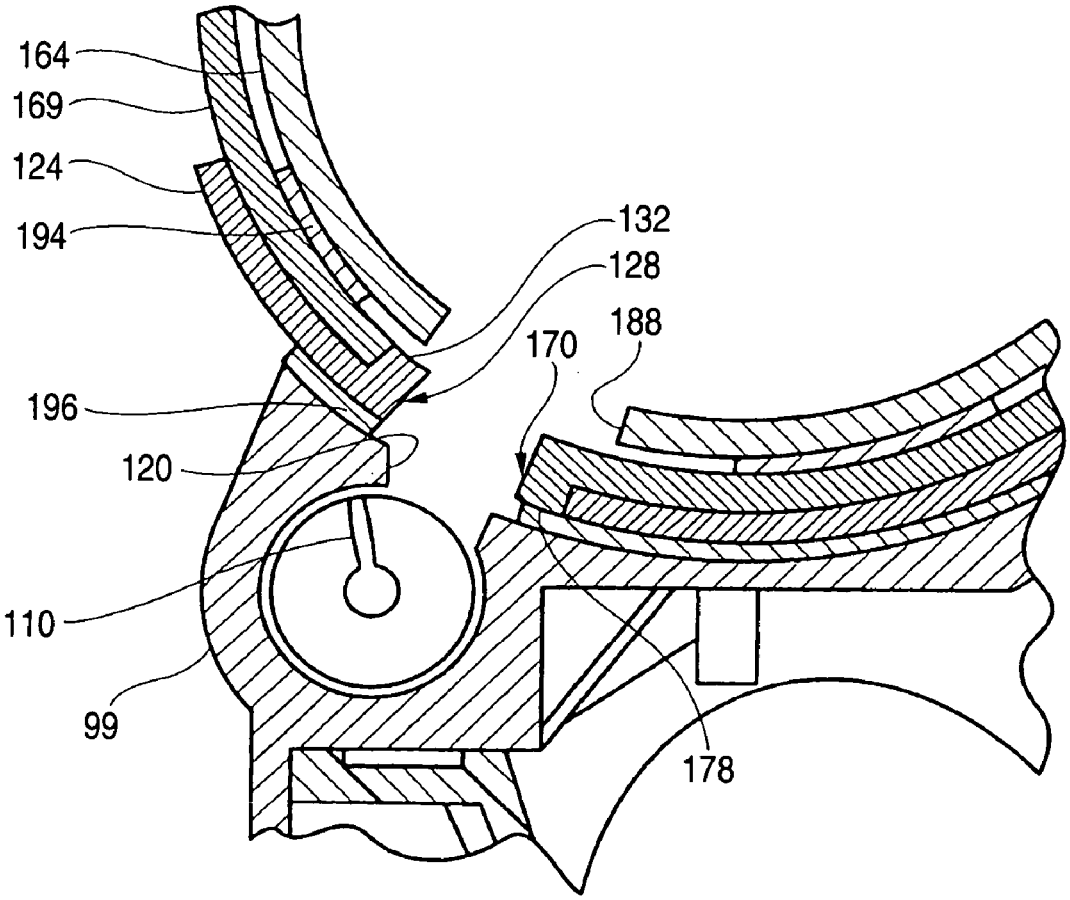
FIG. 12 is an enlarged cross-sectional view showing a developing agent supply port and a developing agent inlet port of the developing agent cartridge shown in FIG. 11 and their vicinity.

FIGS. 11 and 12 show details of the developing agent cartridge 100 attached to the developing device 42. When the developing agent cartridge 100 is attached to the developing device 42, the developing agent supply port 188 is positioned so as to oppose the developing agent inlet port 120. The grip section 102 is pressed so as to move in the rotating direction of the developing device unit 38 (leftward in FIG. 11). Accordingly, the cartridge shutter 169 rotates leftward (counterclockwise in FIG. 11) along the cylinder section 164. As described above, when the cartridge shutter 169 rotates counterclockwise, the developing device shutter 124 engages with the cartridge shutter 169 by means of the supply port protrusion 178 and the inlet port protrusion 132 and slides; the developing agent supply port 188 and the developing agent inlet port 120 are opened; and the developing agent is supplied from the developing agent cartridge 100 to the developing device 42.

A cartridge sealing member 194 is disposed in the vicinity of the developing agent supply port 188 between the cylinder section 164 and the cartridge shutter 169. The cartridge sealing member 194 is, for instance, affixed on the outer surface of the cylinder section 164. That is, the cartridge shutter 169 slides with respect to the cartridge sealing member 194, and rotates with respect to the cylinder section 164 by way of the cartridge sealing member 194. The cartridge sealing member 194 reduces penetration of the developing agent into the space between the cylinder section 164 and the cartridge shutter 169, and reduces friction and the contact area of the cartridge shutter 169 with respect to the cylinder section 164, thereby smoothing rotating motion. In addition, a developing device sealing member 196 is disposed in the vicinity of the developing agent inlet port 120 between the developing device main body 99 and the developing device shutter 124. The developing device sealing member 196 is, for instance, affixed on the developing device main body 99. That is, the developing device shutter 124 slides with respect to the developing device sealing member 196. The developing device sealing member 196 reduces penetration of the developing agent into the space between the developing device main body 99 and the developing device shutter 124, and reduces friction and the contact area of the developing device shutter 124 with respect to the developing device main body 99, thereby smoothing sliding motion.

When the developing agent cartridge 100 is detached from the developing device 42, the cartridge shutter 169 rotates clockwise along the cylinder section 164; the cartridge shutter 169 closes the developing agent supply port 188; and the developing device shutter 124 is pressed by the cartridge shutter 169 so as to close the developing agent inlet port 120. Accordingly, developing agent leakage from the developing agent cartridge 100 and that from the developing device 42 are prevented.

Furthermore, when the cartridge shutter 169 rotates with respect to the cylinder section 164, the discharge protrusion 134 and the collecting port protrusion 180 engage with each other, thereby opening and closing the developing agent discharge port 122 and the developing agent collecting port 190. In addition, as is the case with the toner inlet port 120 and the toner supply port 188, the developing device sealing member 196 and the cartridge sealing member 194 may be respectively provided in the vicinity of the developing agent discharge port 122 and the developing agent collecting port 190.

Next, a first locking mechanism for locking the rotating section main body 162 with respect to the cylinder section 164 will be described.

Figure 13A:
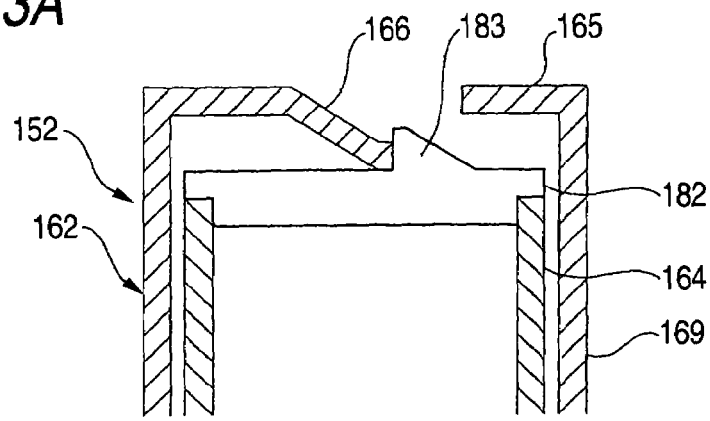
Figure 13B:
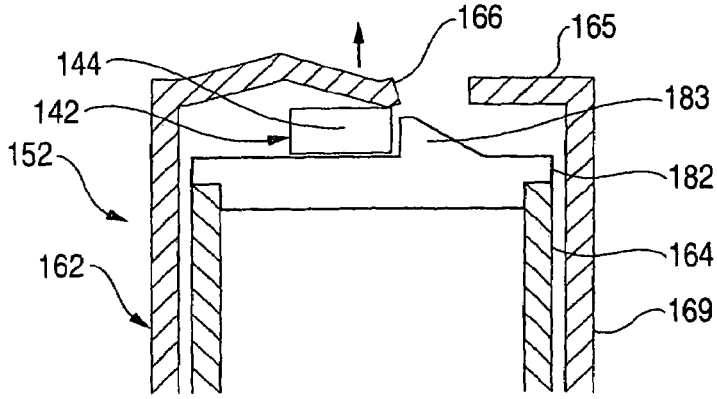
Figure 13C:
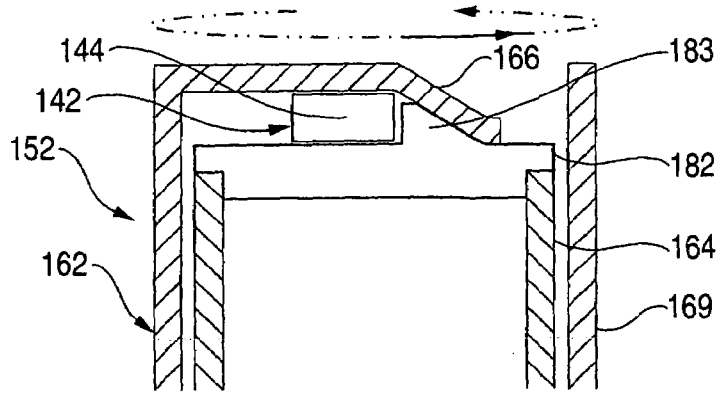

FIGS. 13A to 13C schematically show the first locking mechanism which locks the rotating section main body 162 with respect to the cylinder section 164. As described above, the elastic claw 166 on the side surface section 165 is bent inward with respect to the rotating section main body 162, extends in the rotating direction of the rotating section main body 162, and has elasticity.

Figure 7A:
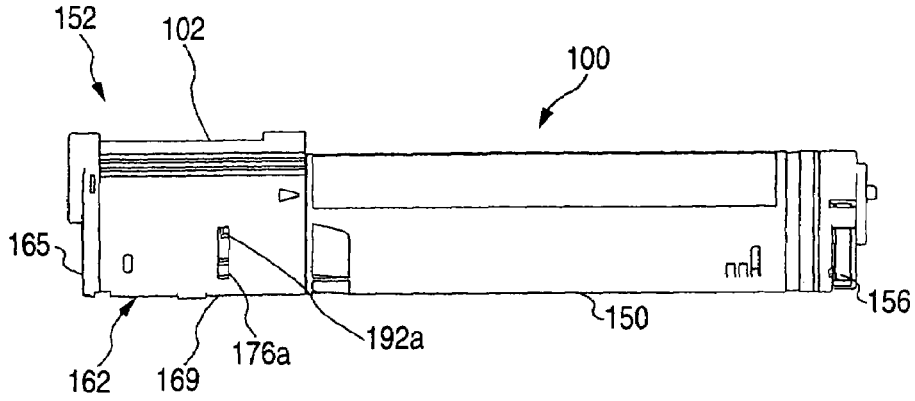
Figure 7B:
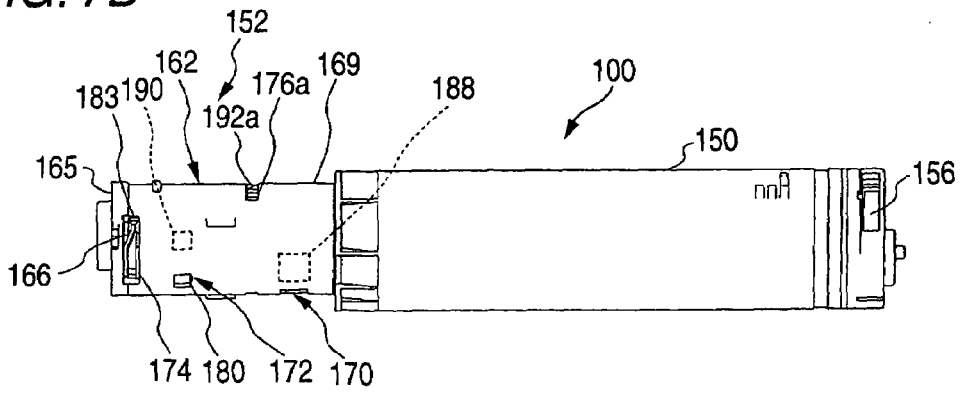
Figure 7C:
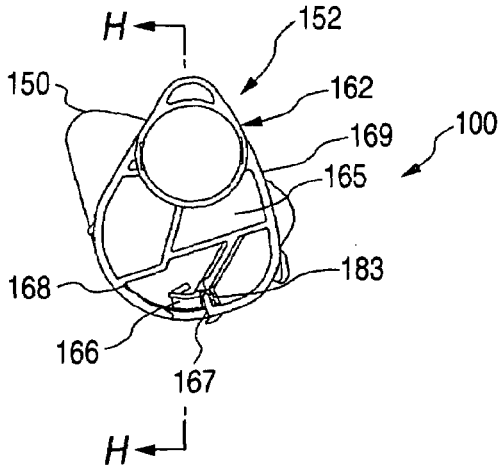
Figure 8:
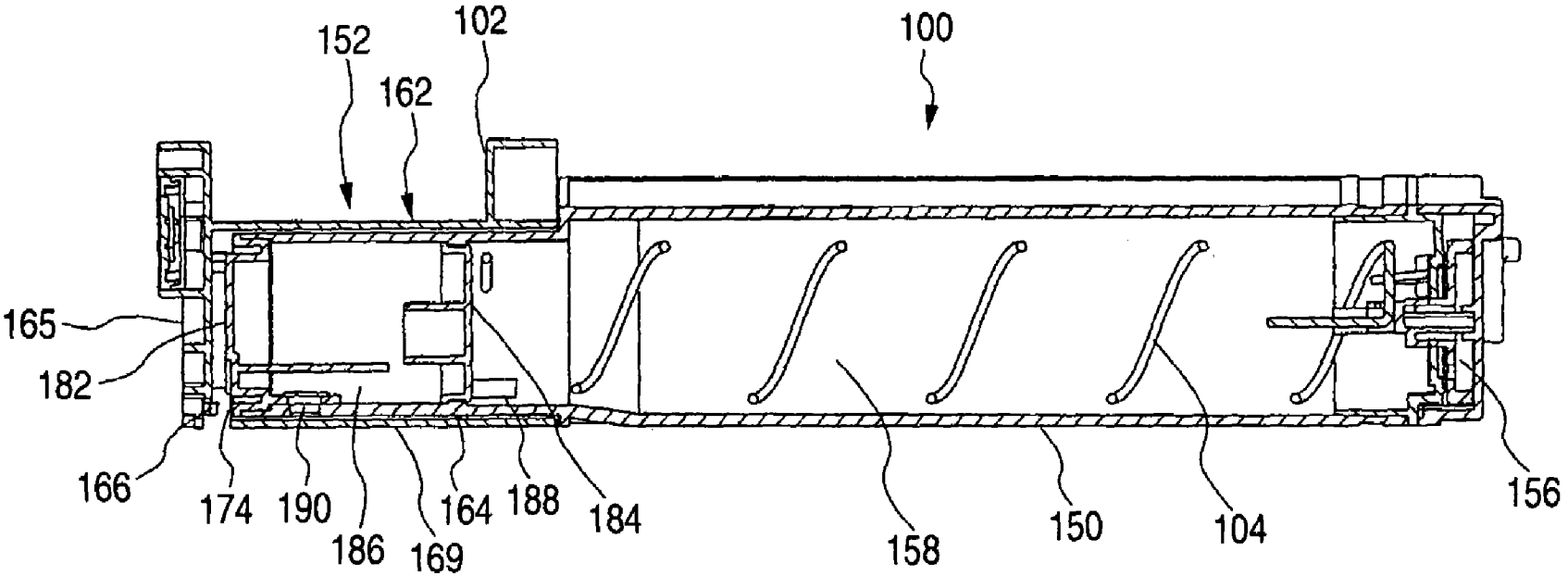
FIG. 8 is a cross-sectional view showing a state where the developing agent cartridge according to the embodiment of the invention is detached from the developing device.

As shown in FIG. 13A, when the developing agent cartridge 100 is detached from the developing device 42, the tip of the elastic claw 166 (the right side in FIG. 13A) is pressed against the locking protrusion 183 on the cylinder sidewall 182, thereby restricting rotating motion of the rotating section main body 162 with respect to the cylinder section 164. More specifically, as also shown in FIGS. 7 and 8, when the developing agent cartridge 100 is detached from the developing device 42, the developing agent supply port 188 and the developing agent collecting port 190 are closed by the cartridge shutter 169, and the rotating section main body 162 is inhibited from rotating in the direction to open the developing agent supply port 188 and the developing agent collecting port 190 with respect to the cylinder section 164.

Furthermore, the regulation holes 176*a* and 176*b* are disposed on the rotating section main body 162 as described above. The range over which the rotating section main body 162 rotates with respect to the cylinder section 164 is restricted by engagement of the regulation holes 176*a* and 176*b* with the regulation protrusions 192*a* and 192*b* (see FIGS. 9A to 9C). That is, when the developing agent cartridge 100 is detached from the developing device 42, the rotating section main body 162 is locked so as not to rotate in either direction.

Figure 9A:
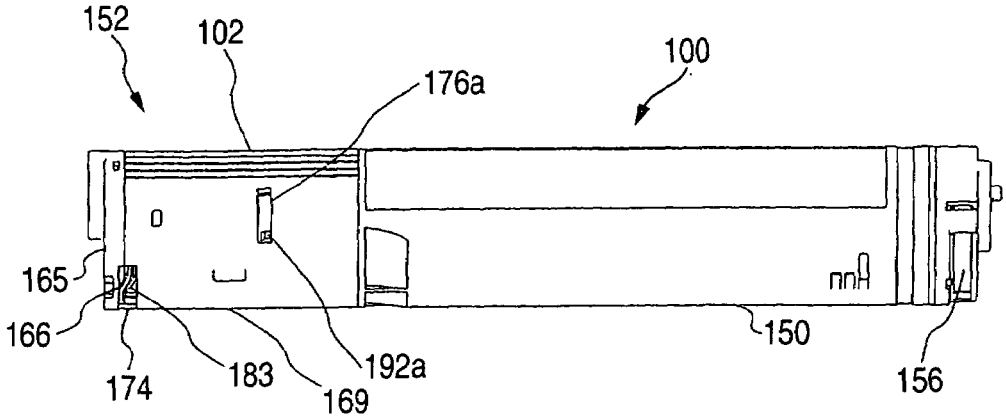
Figure 9B:
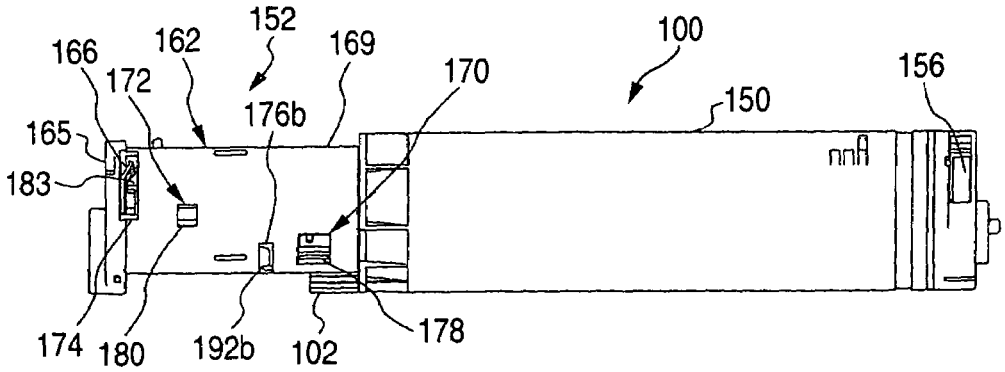
Figure 9C:
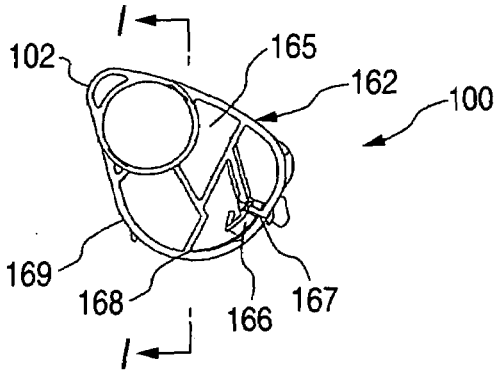
Figure 10:
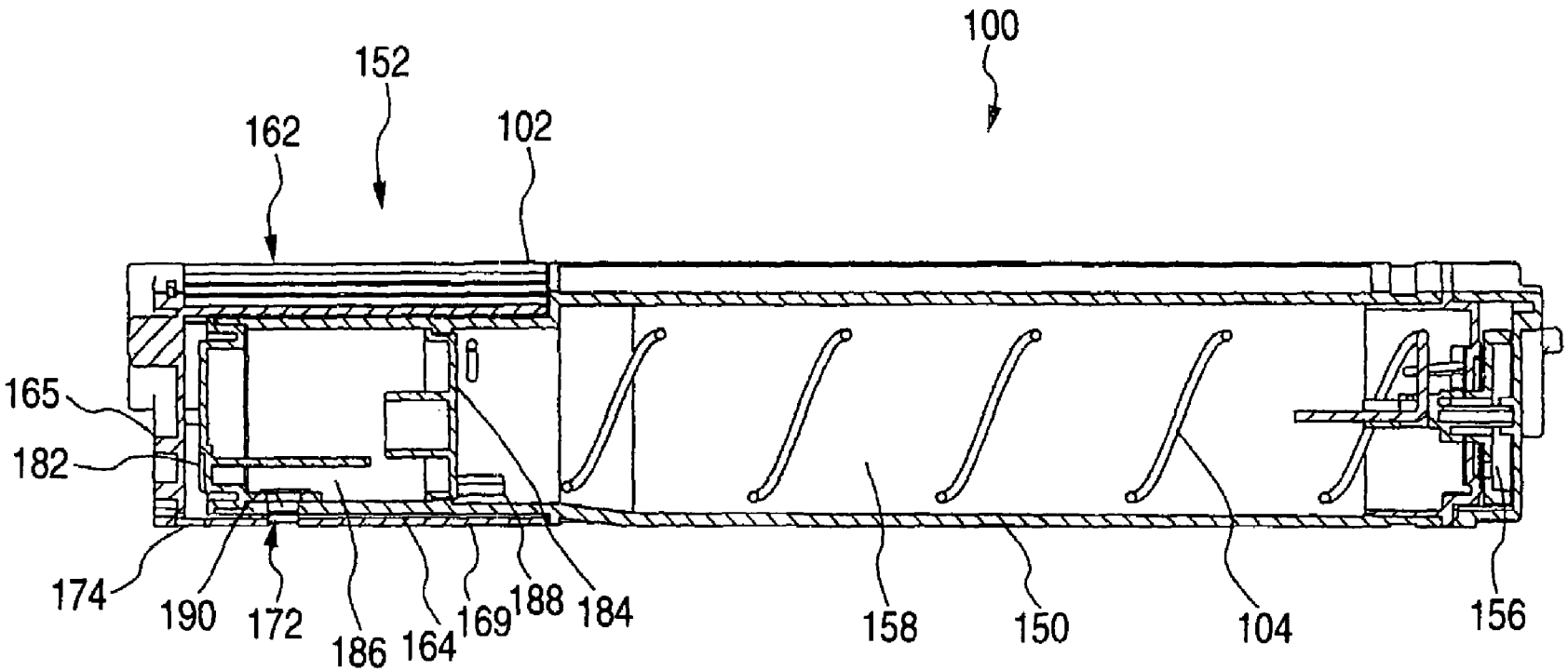
FIG. 10 is a cross-sectional view showing a state where the developing agent cartridge according to the embodiment of the invention is attached to the developing device.

As shown in FIG. 13B, when the developing agent cartridge 100 is guided by the guide 146 of the developing device 42 and pressed against the support member 126, the release rib 142 is inserted between the elastic claw 166 and the cylinder sidewall 182, and the elastic claw 166 is slid along the tilt surface 144. When the release rib 142 is inserted between the elastic claw 166 and the cylinder sidewall 182, the elastic claw 166 is departed from the outer surface of the cylinder-sidewall 182 to a position far from the height of the locking protrusion 183. Accordingly, the elastic claw 166 becomes rotatable in the direction to open the developing agent supply port 188 and the developing agent collecting port 190 (rightward in FIG. 13B and 13C). That is, when the developing agent cartridge 100 is attached to the developing device 42, as also shown in FIG. 9A to FIG. 10, the developing agent supply port 188 and the developing agent collecting port 190 can be opened.

When the rotating section main body 162 is rotated in the direction to close the developing agent supply port 188 and the developing agent collecting port 190 (leftward in FIGS. 13A to 13C), the elastic claw 166 slides along the tilt surface provided on the locking protrusion 183, and closes the developing agent supply port 188 and the developing agent collecting port 190. Thereafter, the tip of the elastic claw 166 is pressed against the locking protrusion 183. As described above, when the developing agent cartridge 100 is attached to the developing device 42, the rotating section main body 162 rotates within the range restricted by the regulation holes 176*a* and 176*b*. When the developing agent cartridge 100 is detached from the developing device 42, the rotating section main body 162 cannot rotate in either direction. Therefore, when the developing agent cartridge 100 is detached from the developing device 42, developing agent leakage from the developing agent cartridges 100*a* to 100*d* can be prevented.

Next, a second locking mechanism for locking the developing agent cartridge 100 with respect to the developing device 42 will be described.

Figure 14:
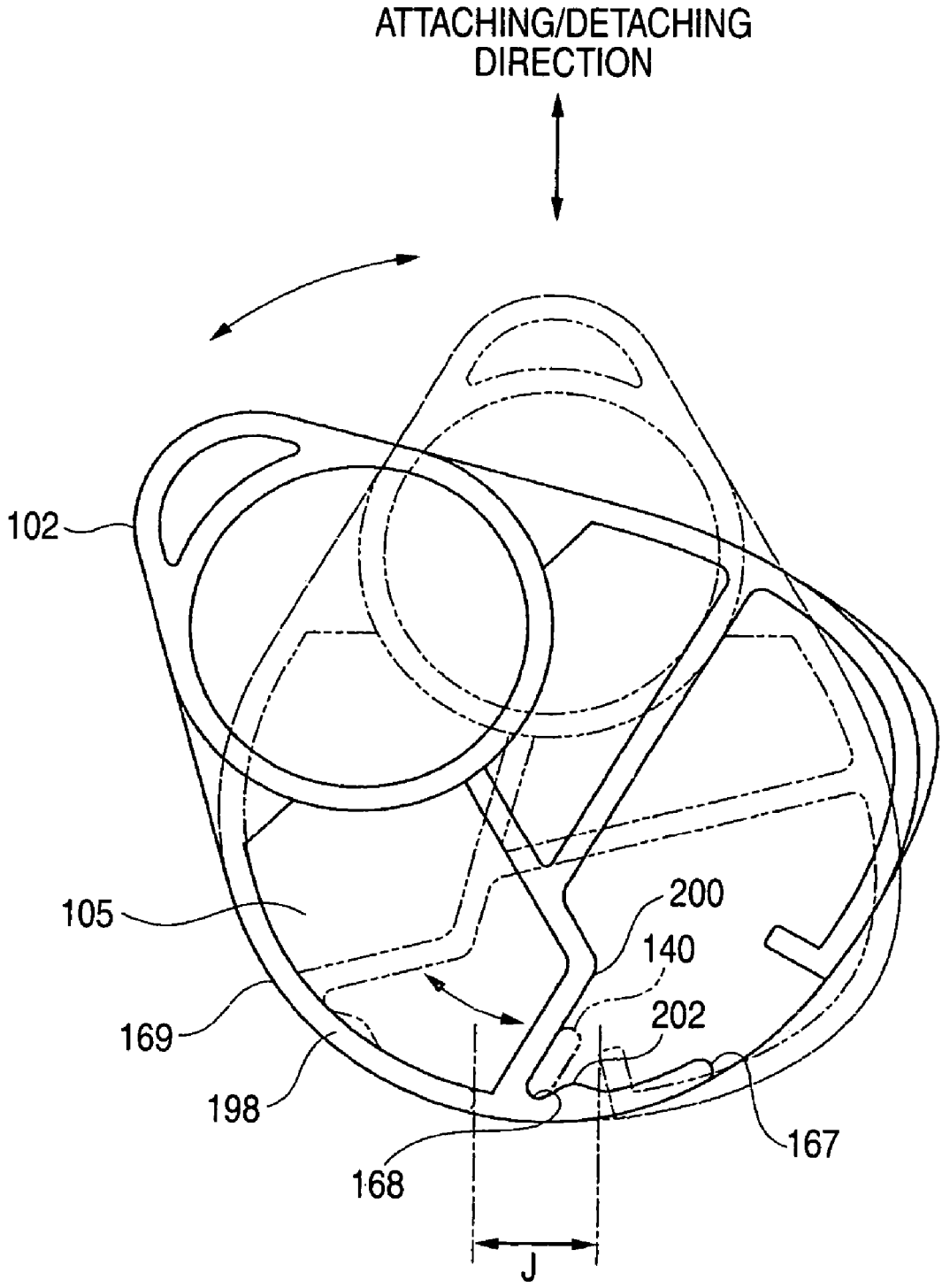
FIG. 14 is a side view of the developing agent cartridge showing a second locking mechanism for locking the developing agent cartridge according to the embodiment of the invention with respect to the developing device.

FIG. 14 shows details of the side surface section 165 and the second locking mechanism for locking the developing agent cartridge 100 with respect to the developing device 42. A periphery wall 198 surrounding the periphery of the side surface section 165 is formed on the side surface section 165. The attachment/detachment groove 167, which allows the regulation section 140 (see FIG. 3) to pass through therein, and the receiving groove 168 to be engaged with the regulation section 140 are formed in the periphery wall 198. The receiving groove 168 has a regulation surface 200 which extends from the periphery wall 198 and faces in the rotating direction of the rotating section main body 162, and a protruding section 202 which protrudes from the periphery wall 198 toward substantially the center of the side surface section 165.

When the developing agent cartridge 100 is attached to the developing device 42, the developing agent cartridge 100 is pressed such that the regulation section 140 (see FIG. 3) disposed on the developing device 42 passes through between the width J of the attaching/detaching direction of the attachment/detachment groove 167 provided in the side surface section 165. When the rotating section main body 162 rotates in the direction to open the developing agent supply port 188 and the developing agent collecting port 190 (counterclockwise in FIG. 14) after the regulation section 140 has passed through the attachment/detachment groove 167, the regulation section 140 is sandwiched between the regulation surface 200 and the protruding section 202. In other words, when the rotating section main body 162 rotates in the direction to open the developing agent supply port 188 and the developing agent collecting port 190, the receiving groove 168 engages with the regulation section 140, whereby the developing agent cartridge 100 is locked in the developing device 42.

Meanwhile, when the developing agent cartridge 100 is detached from the developing device 42, the rotating section main body 162 is rotated in the direction to close the developing agent supply port 188 and the developing agent collecting port 190 (clockwise in FIG. 14). Accordingly, the protruding section 202 is slid along the regulation section 140, whereby the attachment/detachment groove 167 is displaced to a location which allows the regulation section 140 to pass through in the attaching/detaching direction. In other words, when the rotating section main body 162 is rotated in the direction to close the developing agent supply port 188 and the developing agent collecting port 190, the receiving groove 168 is released from the regulation section 140, thereby releasing locking of the developing agent cartridge 100 with respect to the developing device 42.

Next, effects of the embodiment will be described.

When an image forming signal is transmitted, the image carrier 50 is uniformly charged by the electrifying device 52. Light rays are emitted toward the thus-charged image carrier 50 from the exposure device 60 on the basis of an image signal. The light rays emitted from the exposure device 60 expose the surface of the image carrier 50, thereby forming a latent image.

The latent image carried by the image carrier 50 is developed by the developing device unit 38 at the developing position A. In the developing device unit 38, the developing devices 42*a* to 42*d* are respectively supplied with developing agent images of yellow, magenta, cyan, and black from the developing agent cartridges 100*a* to 100*d*. Further, developing agents excessively supplied to the developing devices 42*a* to 42*d* are respectively collected into the developing agent cartridges 100*a* to 100*d*. Toner images of the respective colors developed by the developing devices 42*a* to 42*d* of the developing device unit 38 are primarily transferred by means of being superposed on the intermediate transfer member 64. Waste developing agents remaining on the image carrier 50 after the primary transfer are scraped by the image carrier cleaner 54 and collected.

Meanwhile, in response to a paper supply signal or the like, paper stored in the paper supply cassette 22 is fed by the feed roller 24; turned up by the retard roller 26; guided to the transport path 28; temporarily stopped by the registration roller 32; and at an adjusted timing, guided to the space between the secondary transfer roller 80 and the secondary back-up roller 72. When the paper is guided to the space between the secondary transfer roller 80 and the secondary transfer back-up roller 72, the developing agent image which has been primarily transferred on the intermediate transfer member 64 is secondarily transferred on the paper by means of the secondary transfer roller 80 and the secondary transfer back-up roller 72. Waste developing agents remaining on the intermediate transfer member 64 after the secondary transfer are scraped by the intermediate transfer member cleaner 82 and collected.

The paper on which the developing agent image is transferred is guided to the fuser 90, where the developing agent image is fixed by thermal pressure applied by the heating roller 92 and the pressing roller 94. The paper on which the developing agent image is fixed is discharged by the discharge roller 34 to the discharge section 36 by way of the discharge port 30.

In the case where the developing agent in the developing agent cartridge 100 in the developing device unit 38 is consumed, or the like, the developing agent cartridge 100 is replaced.

Figure 15:
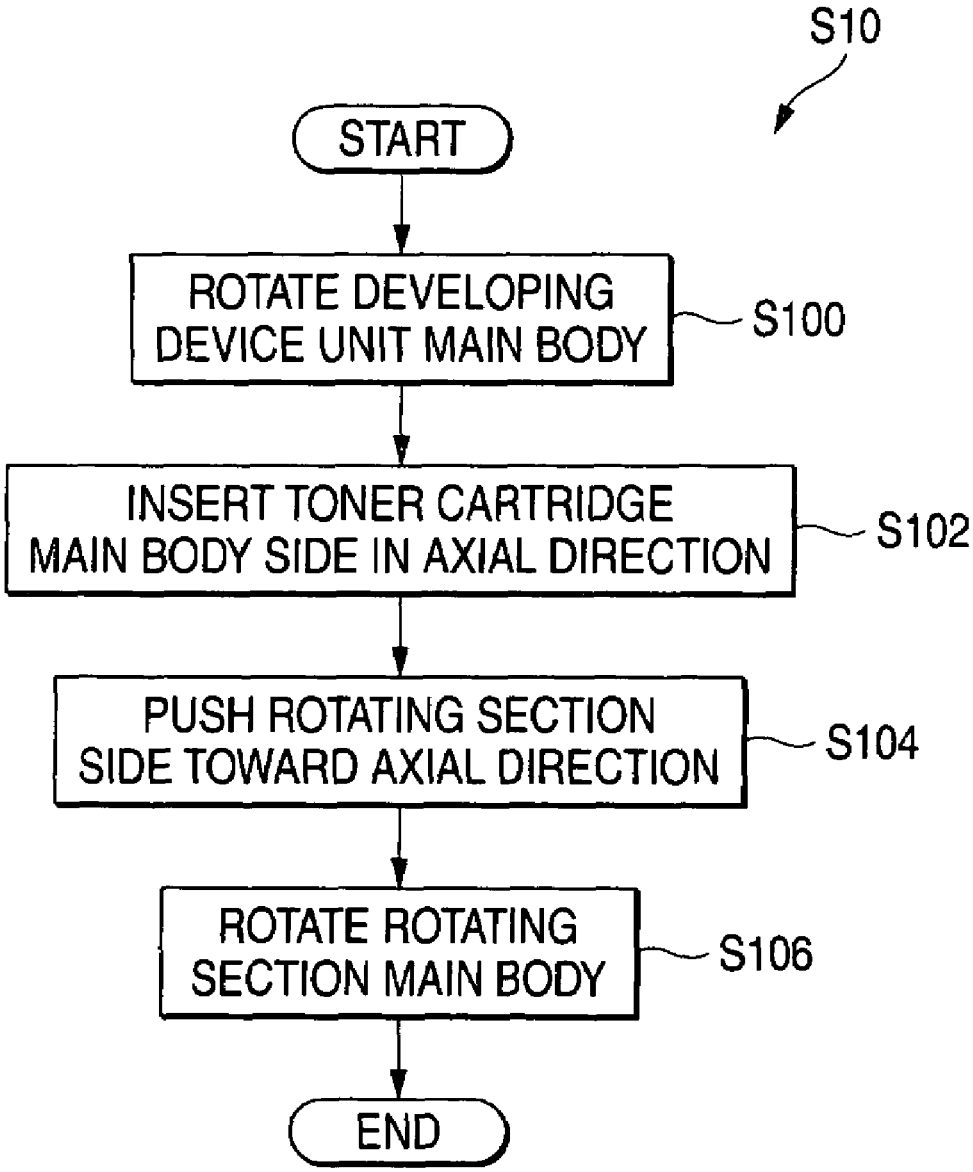
FIG. 15 is a flow chart showing a procedure for attaching the developing agent cartridge according to the embodiment of the invention to the developing device.

FIG. 15 shows a flow chart (S10) indicating a procedure for attaching the developing agent cartridge 100 to the developing device 42. FIGS. 16 to 19 show states of the developing agent cartridge 100 and the developing device 42 corresponding to the flow chart shown in FIG. 15.

As shown in FIG. 15, in step S100, an operator rotates the developing device unit main body 98 so that the developing device 42 to which the developing agent cartridge 100 is to be attached moves to the replacement position on the front side of the image forming apparatus 10.

In step S102, the operator grips the grip section 102 of the developing agent cartridge 100, and inserts the developing agent cartridge main body 150 side in the axial direction (in the X direction in FIG. 16) with respect to the side plate 138. The protruding section 154 of the developing agent cartridge 100 is guided by the guide 146 of the side plate 138, and positioned so that the gear 156 is meshed with the driving force transmitting section 148. When the protruding section 154 is guided by the guide 146, discordance of the locations of the protrusion 155 of the developing agent cartridge 100 with the C-shaped hole 147 of the developing device main body 99 indicates that the color of the developing agent contained in the developing agent cartridge 100 does not coincide with the developing device main body 99. In this case, the developing agent cartridge 100 is not attached to the developing device main body 99.

Figure 16:
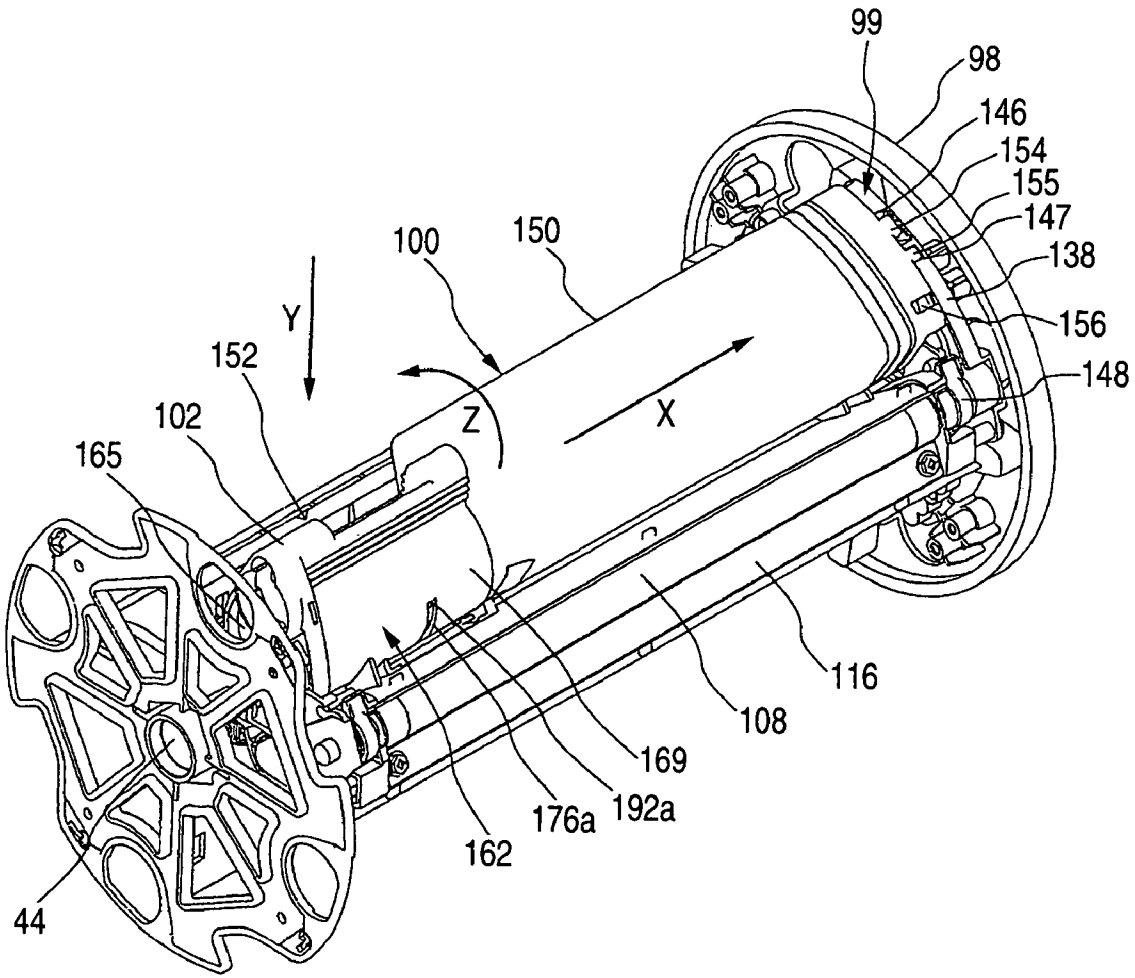
FIG. 16 is a perspective view showing a step for loading the developing agent cartridge into the developing device provided in the developing device unit main body.
Figure 17:
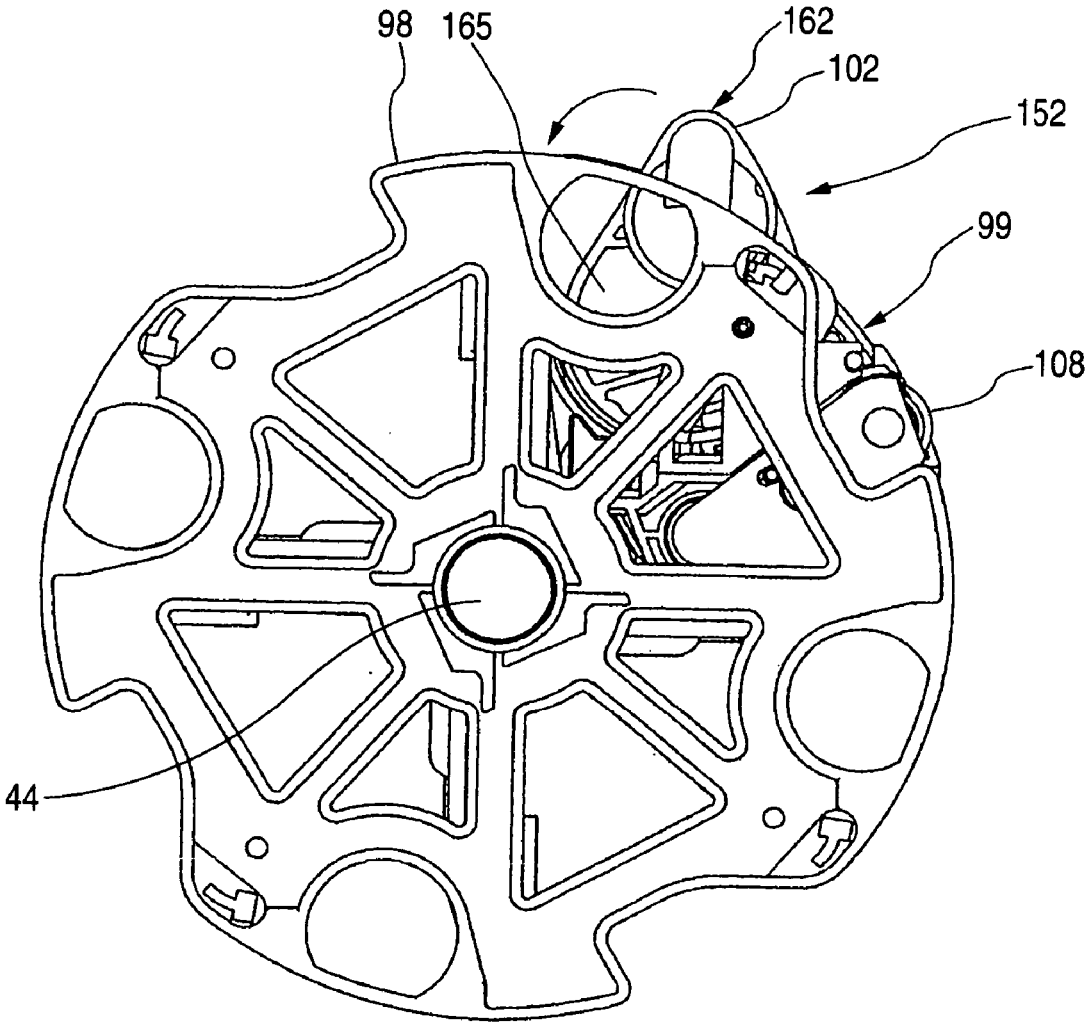
FIG. 17 is a side view showing a step for attaching the developing agent cartridge to the developing device shown in FIG. 16.

In step S104, the operator pushes the rotating section 152 side of the developing agent cartridge 100 toward the rotary shaft 44 of the developing device main body 99 (in the Y direction in FIG. 16), thereby releasing the first locking mechanism (FIGS. 16 and 17).

Figure 18:
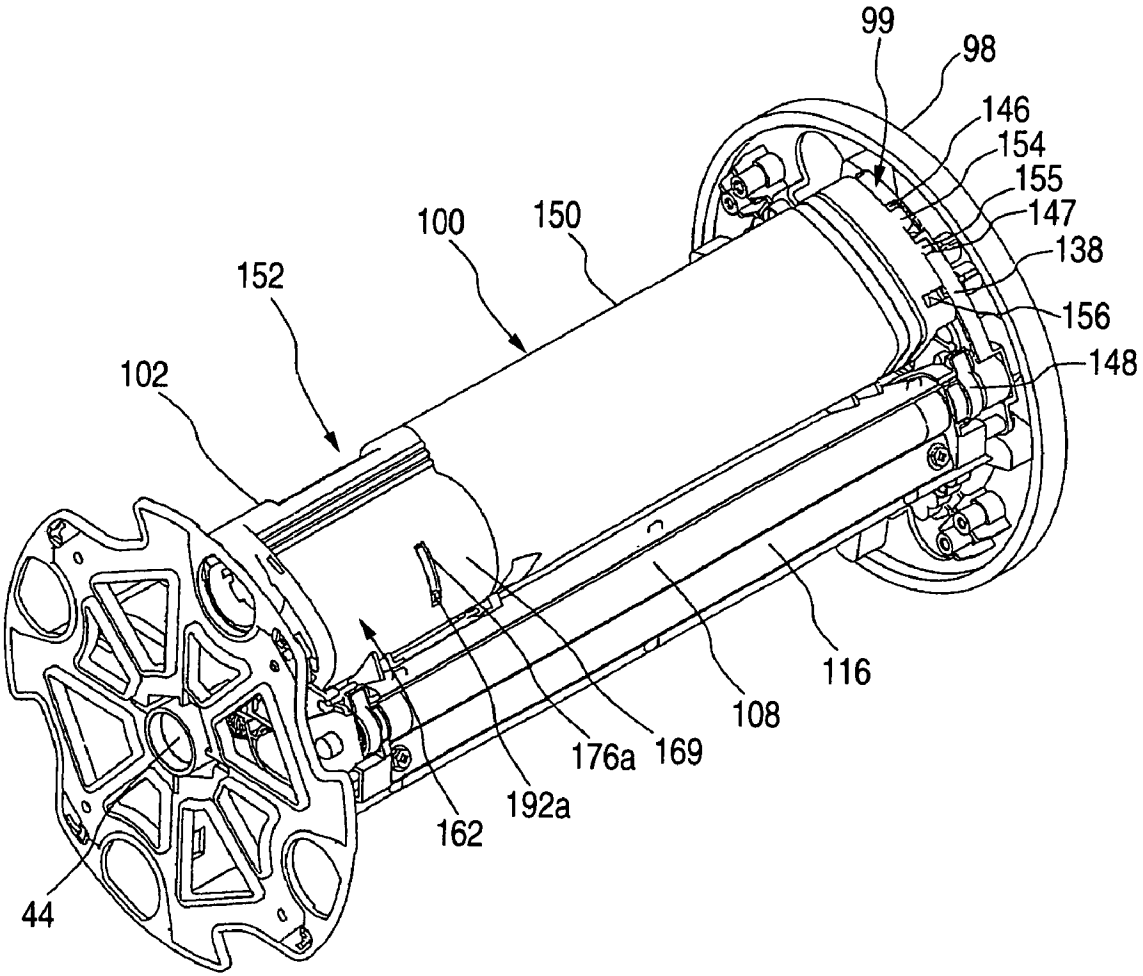
FIG. 18 is a perspective view showing a state where the developing agent cartridge is loaded in the developing device attached to the developing device unit main body.
Figure 19:
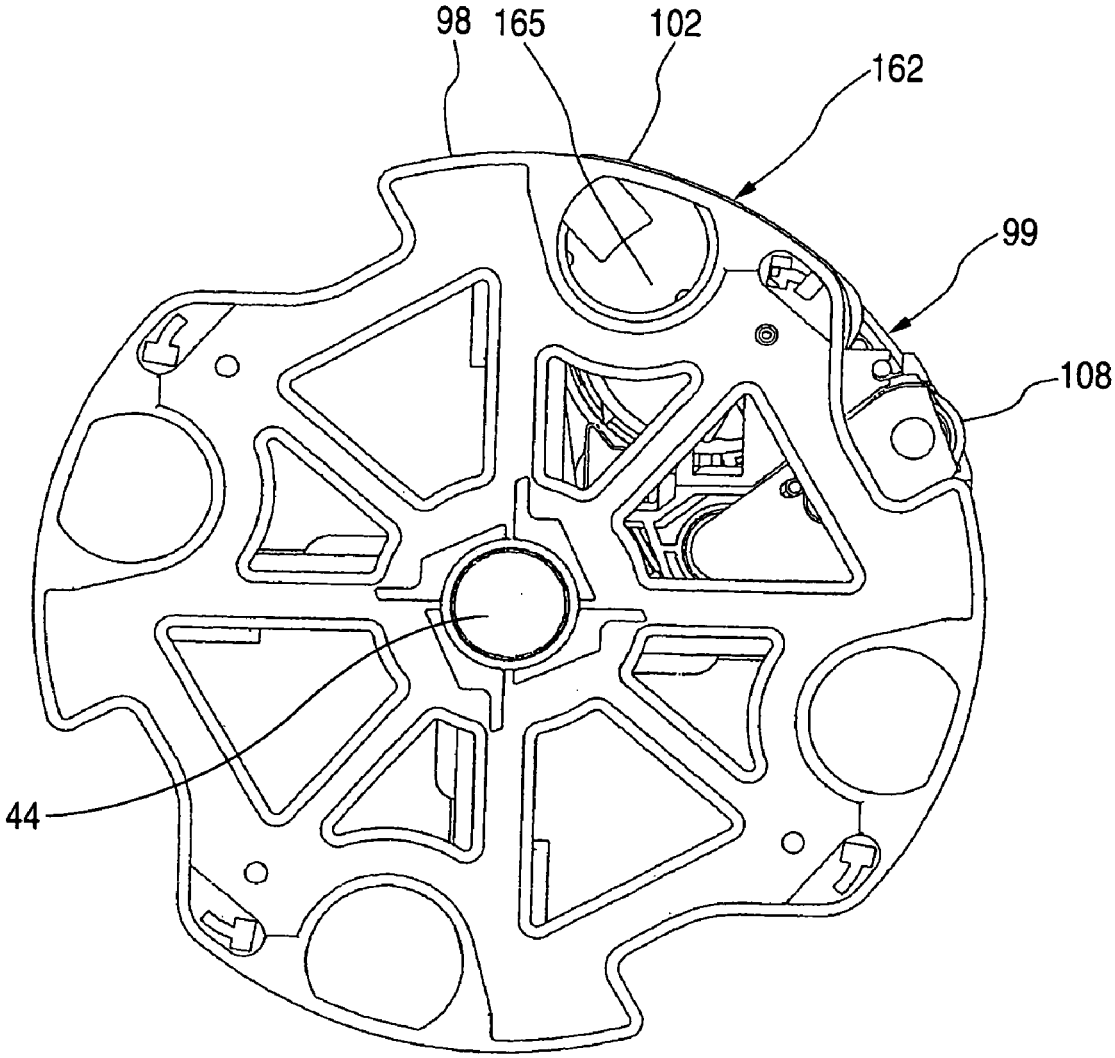
FIG. 19 is a side view showing a state where the developing agent cartridge is loaded into the developing device shown in FIG. 18.

In step S106, the operator rotates the rotating section main body 162 toward the rotating direction of the developing device unit main body 98 (in the Z direction in FIG. 16), thereby locking the developing agent cartridge 100 in the developing device 42 by means of the second locking mechanism (FIGS. 18 and 19). As described above, the developing agent cartridge 100 is locked in the developing device 42 by displacing the grip section 102 in a direction for separating the developing agent cartridge 100 from the developing roller 108 of the developing device 42.

By performing the above-mentioned steps S102 to S106 in reverse order at the replacement position for the developing agent cartridge 100, the operator can detach the developing agent cartridge 100 from the developing device 42.

The operator can also easily attach the developing agent cartridge 100 to and detach the same from the developing device 42 by means of gripping the developing agent cartridge main body 150.

The developing agent cartridge may be integrally formed with a developing device, an image carrier, or the like. The developing roller may be covered by a shutter when separated from a developing position.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

a developing device unit in which a plurality of developing devices are rotatably disposed and are sequentially displaced to a developing position for effecting image forming, wherein the developing device unit comprises a developing agent cartridge which is removably attached at a replacement position, in a direction orthogonal to a rotary shaft of the developing device unit and which contains developing agent therein, and wherein when a vertical plane including a rotation center of the developing device unit divides a space into a first space and second space, the developing position of the developing device is located in the first space, and the replacement position for the developing agent cartridges is located in the second space.

2. The image forming apparatus according to claim 1, wherein a partition is provided between the replacement position for the developing agent cartridge and the developing device which has been displaced to the second space.

3. The image forming apparatus according to claim 1, wherein a main body of the image forming apparatus further comprises an opening through which the developing agent cartridge passes when the developing agent cartridge is attached to the developing device unit, and wherein the opening is opened to a size substantially equal to that of the developing agent cartridge.

4. An image forming apparatus comprising:

a developing device unit in which a plurality of developing devices are rotatably disposed and are sequentially displaced to a developing position for effecting image forming, wherein the developing device unit comprises a developing agent cartridge which is removably attached at a replacement position, in a direction orthogonal to a rotary shaft of the developing device unit and which contains developing agent therein, and wherein when a plane which is vertical to a line connecting a rotation center of the developing device unit and the developing position of the developing device divides a space into a first space and second space, the developing position of the developing device is located in the first space, and the replacement position for the developing agent cartridges is located in the second space.

5. An image forming apparatus comprising:

a developing device unit in which a plurality of developing devices are rotatably disposed and are sequentially displaced to a developing position for effecting image forming, wherein the developing device unit comprises a developing agent cartridge which is removably attached at a replacement position, in a direction orthogonal to a rotary shaft of the developing device unit and which contains developing agent therein, and wherein the replacement position for the developing agent cartridge is located so as to substantially oppose the developing position of the developing device with respect to a rotation center of the developing device unit.

6. The image forming apparatus according to claim 5, wherein the developing agent cartridge comprises a developing agent supply port for supplying developing agent to the developing device, a supply port open/close member for opening/closing the developing agent supply port, and a grip section for controlling the supply port open/close member, and wherein the supply port open/close member and the grip section are integrally formed.

7. The image forming apparatus according to claim 6, wherein the developing agent cartridge is attached to/detached from the developing device unit by an operator holding the grip section.

8. The image forming apparatus according to claim 6, wherein the developing agent cartridge is locked under a state where the developing agent supply port is closed by the supply port open/close member, when the developing agent cartridge is detached from the developing device unit.

9. The image forming apparatus according to claim 6, wherein the developing agent cartridge is locked with respect to the developing device unit with the developing agent supply port open when the developing agent cartridge is attached to the developing device unit.

* * * * *